US010239718B1

(12) United States Patent
Matsui

(10) Patent No.: US 10,239,718 B1
(45) Date of Patent: Mar. 26, 2019

(54) SHEET FEEDER

(71) Applicant: BROTHER KOGYO KABUSHIKI KAISHA, Nagoya-shi, Aichi-ken (JP)

(72) Inventor: Yuki Matsui, Kiyosu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/926,154

(22) Filed: Mar. 20, 2018

(30) Foreign Application Priority Data

Sep. 29, 2017 (JP) ..... 2017-189937

(51) Int. Cl.

| | |
|---|---|
| ***B41J 2/01*** | (2006.01) |
| ***B65H 7/14*** | (2006.01) |
| ***B41J 13/00*** | (2006.01) |
| ***B41J 13/03*** | (2006.01) |
| ***B41J 13/10*** | (2006.01) |
| ***B65H 3/06*** | (2006.01) |
| ***B65H 7/20*** | (2006.01) |

(52) U.S. Cl.
CPC ..... *B65H 7/14* (2013.01); *B41J 13/0018* (2013.01); *B41J 13/03* (2013.01); *B41J 13/103* (2013.01); *B65H 3/0684* (2013.01); *B65H 7/20* (2013.01); *B65H 2511/152* (2013.01); *B65H 2511/51* (2013.01); *B65H 2511/515* (2013.01); *B65H 2553/412* (2013.01); *B65H 2553/612* (2013.01); *B65H 2553/82* (2013.01)

(58) Field of Classification Search
CPC ..... B65H 7/14; B41J 13/0009; B41J 13/00; B41J 13/08
USPC ..... 347/101, 104
See application file for complete search history.

(56) References Cited

U.S. PATENT DOCUMENTS

| | | | | |
|---|---|---|---|---|
| 6,435,499 | B1 * | 8/2002 | Tomatsu | B65H 1/12 271/147 |
| 7,515,867 | B2 * | 4/2009 | Yano | G03G 15/6511 399/388 |
| 2016/0185143 | A1 | 6/2016 | Aoki et al. | |

FOREIGN PATENT DOCUMENTS

| | | | |
|---|---|---|---|
| JP | 7-193692 | A | 7/1995 |
| JP | 2016-124669 | A | 7/2016 |
| JP | 2016-190737 | A | 11/2016 |

* cited by examiner

*Primary Examiner* — An Do
(74) *Attorney, Agent, or Firm* — Merchant & Gould P.C.

(57) ABSTRACT

A contact member swingably moves about a swing axis to contact a recording medium stacked on a medium tray, and shifts to different states depending on volume of medium. A controller performs: a detection process of detecting the stacked volume based on signals of M times outputted from the sensor, the M times being a number of times that is larger than or equal to two times; a stack determination process of determining whether the recording medium is stacked on the medium tray based on signals of N times, the signals of N times being a part of the signals of the M times outputted from the sensor, the N times being a number of times that is smaller than M; and a sheet feeding process of controlling the feed roller to feed the recording medium, in response to determining that the recording medium is stacked on the medium tray.

12 Claims, 17 Drawing Sheets

FIG. 11

| | SENSOR 76 | SENSOR 77 | DISPLAY 150 |
|---|---|---|---|
| 250 SHEETS (PARTICULAR VOLUME A1) | OFF | OFF | LARGE VOLUME OF PAPER STACKED |
| 150 SHEETS (PARTICULAR VOLUME A2) | ON | | MEDIUM VOLUME OF PAPER STACKED |
| 50 SHEETS (PARTICULAR VOLUME A3) | | ON | NEAR EMPTY |
| 1 SHEET (PARTICULAR VOLUME A4) | OFF | | EMPTY |
| 0 SHEET | | | |

SHEET FEEDER

CROSS REFERENCE TO RELATED APPLICATIONS

This application claims priority from Japanese Patent Application No. 2017-189937 filed Sep. 29, 2017. The entire content of the priority application is incorporated herein by reference.

TECHNICAL FIELD

This disclosure relates to a sheet feeder and so on.

BACKGROUND

Conventionally, a sheet feeder (paper feeder) has been known that includes a paper existence sensor for detecting whether a paper feeding tray includes therein a recording sheet. For example, a configuration to use a paper existence sensor using a swing-type actuator to detect whether a paper feeding tray includes therein a recording sheet is disclosed. Specifically, the actuator is provided to contact the recording sheet provided in the paper feeding tray and swingably moves depending on the volume of the recording sheets provided in the paper feeding tray. The sensor is provided to output a signal depending on the position of the actuator. The sensor outputs a different signal depending on the state where the paper feeding tray includes therein recording sheets and the state where the paper feeding tray does not include therein recording sheets, thereby detecting the existence of the recording sheets in the paper feeding tray.

In a conventional sheet feeder including the paper existence sensor, it has been known that a feeding operation is performed on condition that the paper feeding tray includes therein recording sheets based on a signal output from the sensor.

SUMMARY

According to one aspect, this specification discloses a sheet feeder. The sheet feeder includes a medium tray, a feed roller, a driver, a contact member, a sensor, an urging member, and a controller. A recording medium is stacked on the medium tray. The feed roller is configured to feed the recording medium stacked on the medium tray. The driver is configured to supply driving force to the feed roller. The contact member is configured to swingably move about a swing axis to contact the recording medium stacked on the medium tray. The contact member is configured to shift to different states depending on a stacked volume of the recording medium. The sensor is configured to output different signals depending on a state of the contact member. The urging member is configured to urge the contact member toward a position corresponding to the stacked volume that no recording medium is stacked on the medium tray. The controller is configured to control the driver. The controller is configured to perform: a detection process of detecting the stacked volume based on signals of M times outputted from the sensor, the M times being a particular number of times that is larger than or equal to two times; a stack determination process of determining whether the recording medium is stacked on the medium tray based on signals of N times, the signals of N times being a part of the signals of the M times outputted from the sensor, the N times being a particular number of times that is smaller than the M times; and a sheet feeding process of controlling the feed roller to feed the recording medium, in response to determining in the stack determination process that the recording medium is stacked on the medium tray.

According to another aspect, this specification discloses an image recording apparatus. The image recording apparatus includes a medium tray, a feed roller, a printer, a driver, a contact member, a sensor, an urging member, and a controller. A recording medium is stacked on the medium tray. The feed roller is configured to feed the recording medium stacked on the medium tray. The printer is configured to record an image on the recording medium fed by the feed roller. The driver is configured to supply driving force to the feed roller. The contact member is configured to swingably move about a swing axis to contact the recording medium stacked on the medium tray. The contact member is configured to shift to different states depending on a stacked volume of the recording medium. The sensor is configured to output different signals depending on a state of the contact member. The urging member is configured to urge the contact member toward a position corresponding to the stacked volume that no recording medium is stacked on the medium tray. The controller is configured to control the driver. The controller is configured to perform: a detection process of detecting the stacked volume based on signals of M times outputted from the sensor, the M times being a particular number of times that is larger than or equal to two times; a stack determination process of determining whether the recording medium is stacked on the medium tray based on signals of N times, the signals of N times being a part of the signals of the M times outputted from the sensor, the N times being a particular number of times that is smaller than the M times; a sheet feeding process of controlling the feed roller to feed the recording medium, in response to determining in the stack determination process that the recording medium is stacked on the medium tray; and a recording process of controlling the printer to record an image on the recording medium fed in the sheet feeding process.

BRIEF DESCRIPTION OF THE DRAWINGS

Embodiments in accordance with this disclosure will be described in detail with reference to the following figures wherein:

FIG. 11 is an explanatory diagram showing paper remaining volumes corresponding to states of the two sensors;

DETAILED DESCRIPTION

In the case of the paper existence sensor using the swing-type actuator, so-called chattering may be caused where the actuator chatters when a user mounts the paper feeding tray to the main body, for example. The occurrence of the chattering requires a long time for the actuator to have a stable position. The sensor has a function to output a signal showing the existence of a recording sheet depending on the position of the actuator. Thus, a long time required for the actuator to have a stable position undesirably requires a time required to sense the existence of the recording sheet. The feeder does not execute the feeding operation until the existence of the recording sheet in the paper feeding tray is detected. Thus, a long time required for the actuator to have a stable position undesirably requires a long time required for the feeding operation to start.

An example of an object of this disclosure is to quickly perform a feeding process of a recording medium in a sheet feeder that detects a stacking state of the recording medium in a stacking part by using a swing-type actuator.

Figure 1:
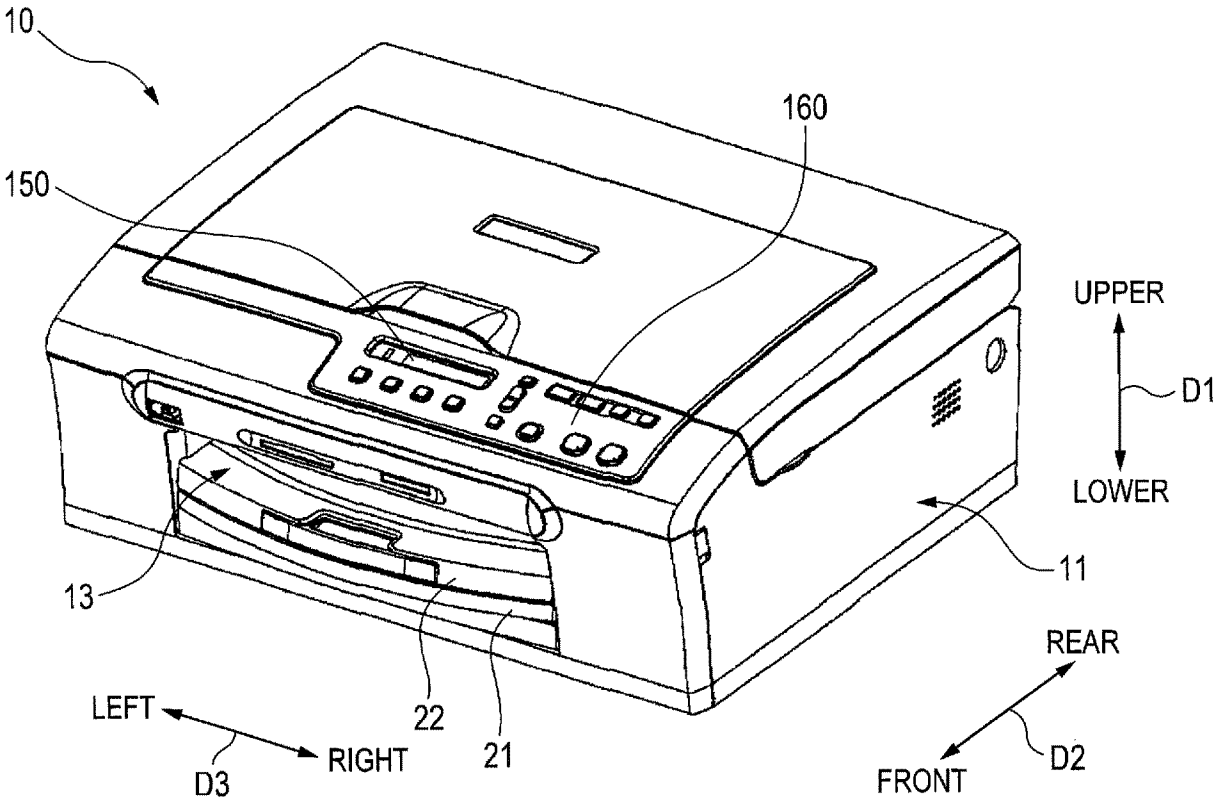
FIG. 1 is a perspective view of an MFP (multifunction peripheral) adopting a paper feeder according to an embodiment.

Hereinafter, referring to the accompanying drawings, embodiments of this disclosure will be explained. In the following description, an upper-lower direction D1 is defined with reference to such a state (the state as shown in FIG. 1) that an MFP (multifunction peripheral) 10 is installed to be usable and adopts a paper feeder 20; a front-rear direction D2 is defined with the side where an opening 13 is provided as the near side (the front side); and a left-right direction D3 is defined as the MFP 10 is viewed from the near side (the front side). Further, while this disclosure may be applied to a sheet feeder having any number of actuators, the description will be made hereinafter on the sheet feeder including two actuators as one example.

[Overall Structure of MFP 10]

As shown in FIG. 1, the MFP 10 has an approximately rectangular-parallelepiped shape, and is provided with a printer unit 11 in a lower part thereof. The MFP 10 has various functions such as a facsimile function, a print function, and so on. As the print function, the MFP 10 has a function of recording image on a single side of a sheet of paper 12 (a sheet-like recording medium; see FIG. 2) by an inkjet method. Further, the MFP 10 may also be a device which records image on both sides of the paper 12. Further, a display 150 and an operating interface 160 are provided in the upper surface of the MFP 10 at the front side. The display 150 displays some states of the MFP 10 (remaining volume of paper and so on, for example). The operating interface 160 receives an operation input by a user.

Figure 2:
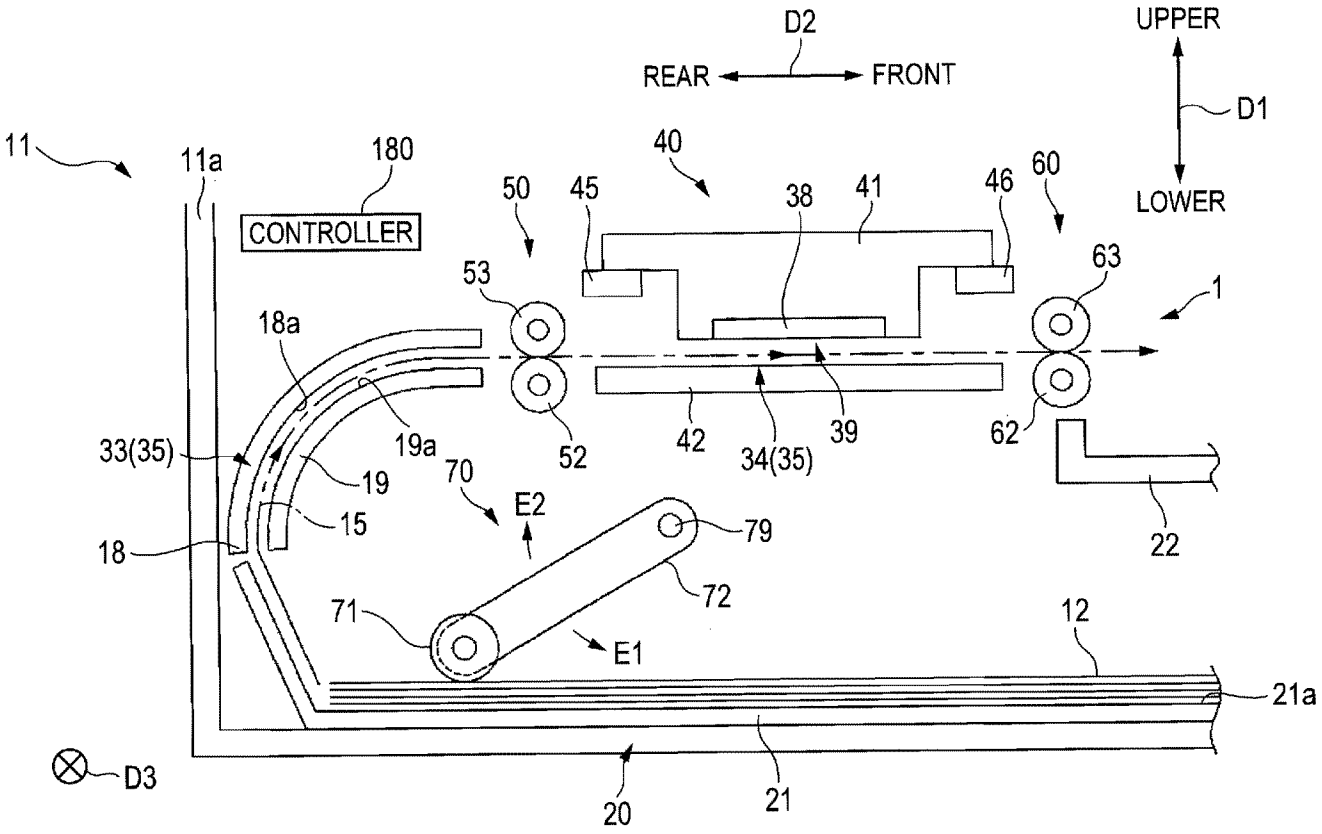
FIG. 2 is a schematic lateral view showing an internal structure of a printer unit of the MFP shown in FIG. 1.

As shown in FIG. 2, the printer unit 11 has a casing 11*a*, a conveying device 1 to convey the paper 12 inside the MFP 10, a recording unit 40, a controller 180, and so on. The casing 11*a* is the main body frame of the printer unit 11 and, as shown in FIG. 2, contains the conveying device 1, the recording unit 40, and the controller 180. The conveying device 1 includes a paper feeder 20 (an example of a sheet feeder), a platen 42, a conveyance roller pair 50 and a discharge roller pair 60 all of which will be described later.

The paper feeder 20 picks up the paper 12 from a paper feeding tray 21 and feeds the same to a conveyance path 35. The conveyance roller pair 50 conveys the paper 12 fed into the conveyance path 35 by the paper feeder 20 to the downstream side in a conveyance direction 15 indicated with the arrows of a one-dot chain line shown in FIG. 2. That is, the conveyance roller pair 50 conveys the paper 12 frontward. The platen 42 supports, from below, the paper 12 conveyed by the conveyance roller pair 50. The recording unit 40 records an image by ejecting ink droplets to the paper 12 supported on the platen 42. The discharge roller pair 60 frontward conveys the paper 12 with the image recorded thereon by the recording unit 40 and discharges the same to a discharge tray 22.

Subsequently, referring to FIG. 1 through FIGS. 8A and 8B, the paper feeder 20 will be explained below. As shown in FIG. 2, the paper feeder 20 has the paper feeding tray 21 and a paper feed unit 70. The paper feed unit 70 picks up the paper 12 from the paper feeding tray 21 and sends the same to the conveyance path 35. The paper feed unit 70 in this embodiment feeds the paper 12 rearward.

As shown in FIG. 1, the opening 13 is formed in the front side of the printer unit 11. The paper feeding tray 21 is supported by the casing 11*a* to be mountable and removable through the opening 13 in the front-rear direction D2. The paper feeding tray 21 accommodates a plurality of sheets of the paper 12 by stacking the plurality of sheets of the paper 12 in a stacked fashion on its bottom surface 21*a*. The discharge tray 22 is arranged above the paper feeding tray 21. The discharge tray 22 moves integrally with the paper feeding tray 21. The discharge tray 22 supports the paper 12 on which the image is recorded by the recording unit 40 and which has been discharged by the discharge roller pair 60.

Figure 3:
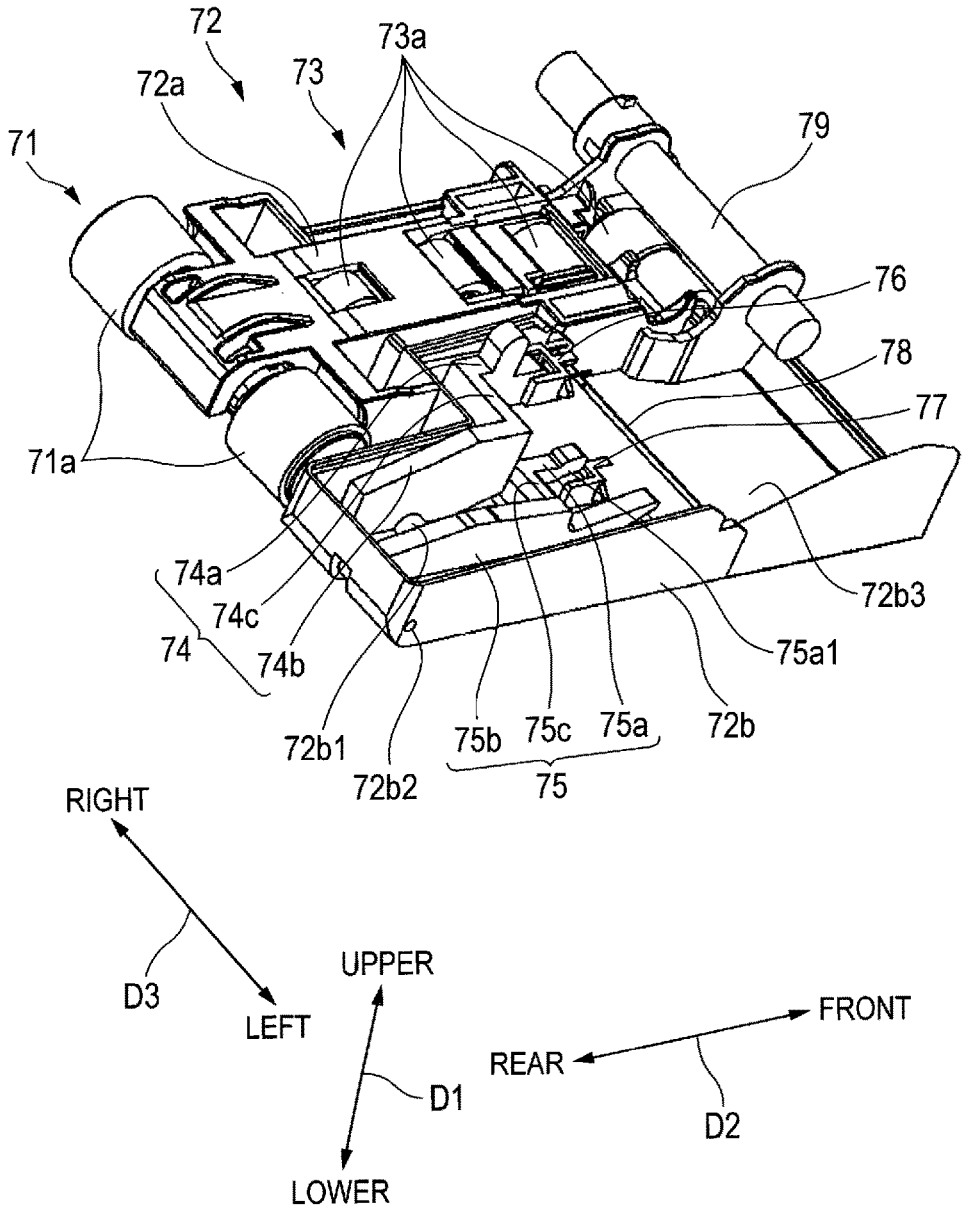
FIG. 3 is a perspective view showing a paper feed unit.

As shown in FIG. 2, the paper feed unit 70 is provided above the paper feeding tray 21 and below the recording unit 40, on the upstream side from the conveyance path 35 in the conveyance direction 15. As shown in FIGS. 2 and 3, the paper feed unit 70 has a paper feed roller 71, an arm 72, a transmission mechanism 73, two actuators 74 and 75 (an example of the contact member), and two sensors 76 and 77.

As shown in FIG. 3, the arm 72 has an arm body 72*a*, and a support frame 72*b* integrated with the arm body 72*a*. As shown in FIG. 2, the arm body 72*a* is supported by the casing 11*a* to be swingable (pivotable) in an arrow E1 direction (counterclockwise) and an arrow E2 direction (clockwise) about a support shaft 79 provided in a base end portion to the front in the front-rear direction D2, as viewed from the left to the right in the left-right direction D3. With this configuration, the arm 72 is also configured to be swingable in the arrow E1 direction and the arrow E2 direction with respect to the casing 11*a*. The support shaft 79 is fixed on the casing 11*a* and arranged above the paper feeding tray 21 in the upper-lower direction D1. The arm body 72*a* rotatably supports the paper feed roller 71 at a distal end portion positioned to the rear in the front-rear direction D2 and, by its own weight, is urged downward in the arrow E1 direction (the counterclockwise direction in FIG. 1). With this configuration, in a state where the paper feeding tray 21 is mounted on the casing 11*a*, the paper feed roller 71 is contactable with the paper 12 stacked on the paper feeding tray 21.

Further, the arm 72 is provided with a retracting member (not shown) to temporarily raise and retract the entire arm 72 up to almost the same height as the support shaft 79, by rotationally moving the arm 72 through a temporary engagement with a lateral wall of the paper feeding tray 21 when inserting or removing the paper feeding tray 21 into or from the casing 11*a*. With this configuration, when inserting or removing the paper feeding tray 21 having the maximal volume of the paper 12 into or from the casing 11*a*, the paper 12 in the paper feeding tray 21 no longer interferes with the paper feed roller 71 and the two actuators 74 and 75, so that it is possible to smoothly carry out the operations of inserting and removing the paper feeding tray 21.

As shown in FIG. 3, the transmission mechanism 73 has a plurality of gears 73*a* supported to be rotatable about a rotary shaft (not shown) along the left-right direction D3, inside the arm body 72*a*. Further, while only four of the gears 73*a* are shown in FIG. 3, one more gear 73*a* not shown in FIG. 3 is provided between a pair of rollers 71*a* inside the distal end portion of the arm body 72*a*. The plurality of gears 73*a* is arranged to engage with each other. A drive force is transmitted from a paper feeding motor 71M (see FIG. 10) to the gear 73*a* arranged in the base end of the arm body 72*a*, so as to rotate the plurality of gears 73*a*.

The paper feed roller 71 has the pair of rollers 71*a*. The pair of rollers 71*a* is arranged with the distal end portion of the arm body 72*a* interposed therebetween in the left-right direction D3. Further, the pair of rollers 71*a* are fixed on a rotary shaft (not shown) of the gear 73*a* provided inside the distal end portion of the arm body 72*a*. The paper feed roller 71 is also rotated by the rotation of the plurality of gears 73*a* of the transmission mechanism 73 due to the drive force of the paper feeding motor 71M. Because of the rotation of the paper feed roller 71, the paper 12 in the paper feeding tray 21 is fed toward the conveyance path 35.

Figure 4A:
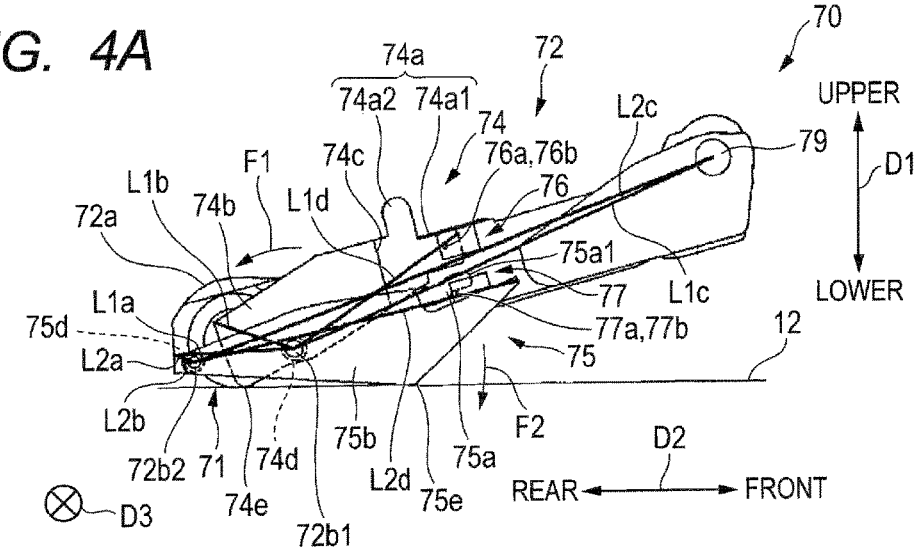
FIG. 4A is an explanatory diagram for explaining a length relationship between an arm body of the paper feed unit and two actuators.

As shown in FIG. 3, the support frame 72*b* has an approximately box-like shape, and is provided on a wall of the arm body 72*a* at the left side in the left-right direction D3. Inside the support frame 72*b*, there are provided the two actuators 74 and 75 and the two sensors 76 and 77. That is, the support frame 72*b* serves for supporting the actuators 74 and 75 and the sensors 76 and 77. The support frame 72*b* is provided with two support shafts 72*b*1 and 72*b*2 extending in the left-right direction D3. As shown in FIG. 4A, the support shaft 72*b*1 is arranged between the support shaft 79 and the support shaft 72*b*2. More specifically, the support shaft 72*b*1 is not only arranged between the support shaft 79 and the support shaft 72*b*2 in the upper-lower direction D1 but also arranged between the support shaft 79 and the support shaft 72*b*2 in the front-rear direction D2. Two openings (not shown) are formed in a bottom 72*b*3 of the support frame 72*b* to penetrate therethrough in the upper-lower direction D1. These openings face the actuators 74 and 75 in the upper-lower direction D1, respectively. With this configuration, it is possible for the actuators 74 and 75 to come into and go out of the support frame 72*b* through the openings, thereby being contactable with the paper 12.

Figure 4B:
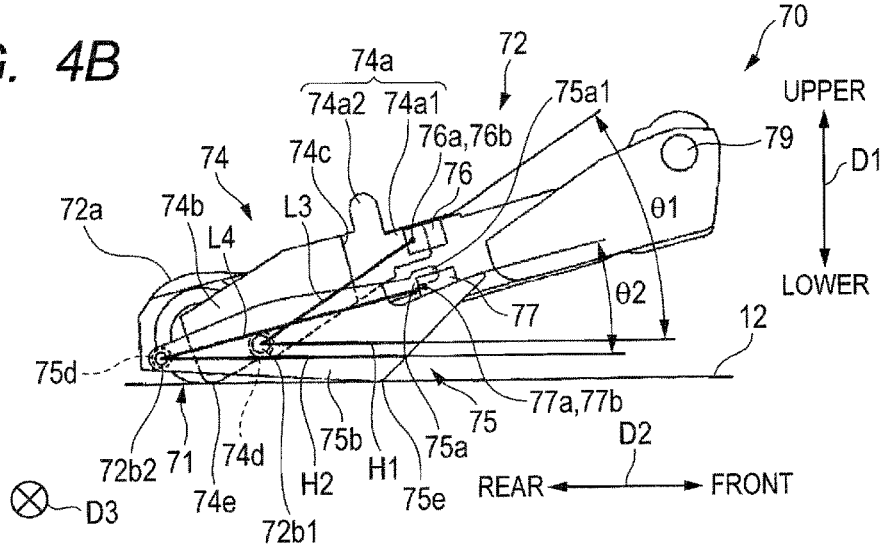
FIG. 4B is an explanatory diagram for explaining an arrangement angle for two sensors of the paper feed unit.

As shown in FIG. 3 and FIGS. 4A and 4B, the actuator 74 is supported by the support frame 72*b* to be swingable about the support shaft 72*b*1 (swingable about a swing axis). The actuator 74 has a front portion 74*a* positioned to the front in the front-rear direction D2, a rear portion 74*b* positioned to the rear, and a connecting portion 74*c* connecting the front portion 74*a* and the rear portion 74*b*. Both the front portion 74*a* and the rear portion 74*b* extend along a direction orthogonal to the support shaft 72*b*1. The connecting portion 74*c* extends in the left-right direction D3. The front portion 74*a* and rear portion 74*b* are arranged to be shifted in position from each other in the left-right direction D3. The actuator 74 is supported by the support shaft 72*b*1 in a lower part in the upper-lower direction D1 in a central part of the rear portion 74*b* in its extending direction. Further, as shown in FIG. 4A, a coil spring 74*d* is provided at the periphery of the support shaft 72*b*1. One end of the coil spring 74*d* engages with the rear portion 74*b* while the other end engages with the support frame 72*b* such that, as shown in FIG. 4A, as viewed from the left to the right in the left-right direction D3, the coil spring 74*d* urges the actuator 74 counterclockwise, that is, in an arrow F1 direction.

As shown in FIG. 4A, a contact portion 74*e* where the actuator 74 contacts the paper 12 stacked on the paper feeding tray 21 is a lower portion of the rear portion 74*b* in the upper-lower direction D1, and is positioned farther away from the support shaft 79 than the support shaft 72*b*1 in the front-rear direction D2. From this point, the actuator 74 is also configured to swing in the same direction as the arm 72. Specifically, if the paper 12 on the paper feeding tray 21 decreases, then the arm 72 swings in the arrow E1 direction. At this time, the actuator 74 also swings in the same direction (arrow F1).

As shown in FIG. 4A, the front portion 74*a* of the actuator 74 is provided with an interference portion 74*a*1 and a contact portion 74*a*2. The interference portion 74*a*1 is formed in the front portion 74*a* to the front in the front-rear direction D2 and configured to be able to interfere with the sensor 76 as will be described later. The contact portion 74*a*2 is formed to the rear from the interference portion 74*a*1 in the front-rear direction D2 to protrude upward from the interference portion 74*a*1 in the upper-lower direction D1, and configured to be contactable with a frame 11*a*1 of the casing 11*a*.

As shown in FIG. 4A, the actuator 74 is configured to be shorter than the arm body 72*a*. In detail, a distance on a virtual line L1*a* is longer than another distance on a virtual line L1*b*, the distance on the virtual line L1*a* being from the support shaft 72*b*1 of the arm body 72*a* to the distal end of the arm body 72*a* (the distal end of the arm 72 distanced farthest from the support shaft 79 on the same side as the paper feed roller 71 from the support shaft 79) while the distance on the virtual line L1*b* being from the position farthest from the support shaft 79 of the actuator 74, to the support shaft 72*b*1. Further, a distance on a virtual line L1*c* from the support shaft 72*b*1 of the arm body 72*a* to the support shaft 79 is longer than another distance on a virtual line L1*d* from the position nearest to the support shaft 79 of the actuator 74, to the support shaft 72*b*1.

As shown in FIG. 3 and FIG. 4A, the actuator 75 is supported by the support frame 72*b* to be swingable about the support shaft 72*b*2. The actuator 75 has a front portion 75*a* positioned to the front in the front-rear direction D2, a rear portion 75*b* positioned to the rear, and a connecting portion 75*c* connecting the front portion 75*a* and the rear portion 75*b*. The rear portion 75*b* extends in a direction orthogonal to the support shaft 72*b*2. The connecting portion 75*c* extends in the left-right direction D3 from a slightly frontward part from the center of the rear portion 75*b* in its extending direction. The front portion 75*a* extends frontward from a right end portion of the connecting portion 75*c*. In this manner, the actuator 75 is also arranged such that the front portion 75*a* is shifted from the rear portion 75*b* in the left-right direction D3. The front portion 75*a* has an interference portion 75*a*1 configured to interfere with the sensor 77 as will be described later. The actuator 75 is supported by the support shaft 72*b*2 in a rear end portion of the rear portion 75*b*. Further, as shown in FIG. 4A, a coil spring 75*d* is provided at the periphery of the support shaft 72*b*2. One end of the coil spring 75*d* engages with the rear portion 75*b* while the other end engages with the support frame 72*b* such that, as shown in FIG. 4A, as viewed from the left to the right in the left-right direction D3, the coil spring 75*d* urges the actuator 75 clockwise, that is, in an arrow F2 direction.

As shown in FIG. 4A, a contact portion 75*e* where the actuator 75 contacts the paper 12 stacked on the paper feeding tray 21 is a lower portion of the rear portion 75*b* at the center in the upper-lower direction D1, and the support shaft 72*b*2 is positioned farther away from the support shaft 79 than the contact portion 75*e* in the front-rear direction D2. From this point, the actuator 75 is also configured to swing in the opposite direction from the arm 72. Specifically, if the paper 12 on the paper feeding tray 21 decreases, then the arm 72 swings in the arrow E1 direction. At this time, the actuator 75 swings in the arrow F2 direction.

Further, as shown in FIG. 4A, the actuator 75 is also configured to be shorter than the arm body 72*a*. That is, a distance on a virtual line L2*a* is longer than another distance on a virtual line L2*b*, the distance on the virtual line L2*a* being from the support shaft 72*b*2 of the arm body 72*a* to the distal end of the arm body 72*a* (the distal end of the arm 72 distanced farthest from the support shaft 79 on the same side as the paper feed roller 71 with respect to the support shaft 79) while the distance on the virtual line L2*b* being from the position farthest from the support shaft 79 of the actuator 75, to the support shaft 72*b*2. Further, a distance on a virtual line L2*c* from the support shaft 72*b*2 of the arm body 72*a* to the support shaft 79 is longer than another distance on a virtual line L2*d* from the position nearest to the support shaft 79 of the actuator 75, to the support shaft 72*b*2. In this manner, the actuator 75 is configured to be shorter than the arm body 72*a*.

Further, the actuator 75 is arranged to be aligned with the actuator 74 along the left-right direction D3. In other words, the two actuators 74 and 75 are arranged at almost the same position in terms of the front-rear direction D2 (the direction in which the paper feed roller 71 feeds the paper 12). Therefore, it is possible to downsize the paper feeder 20 in the front-rear direction D2.

As shown in FIG. 4A, in the actuator 74, the interference portion 74*a*1 is positioned at the opposite side from the contact portion 74*e* with respect to the support shaft 72*b*1. Further, in the actuator 75, the interference portion 75*a*1 is positioned at the opposite side from the support shaft 72*b*2 with respect to the contact portion 75*e*. In this manner, the two actuators 74 and 75 swing in opposite directions from each other (the actuator 74 swings in the arrow F1 direction, and the actuator 75 swings in the arrow F2 direction), along with the decrease in the paper 12 stacked on the paper feeding tray 21.

Figure 5:
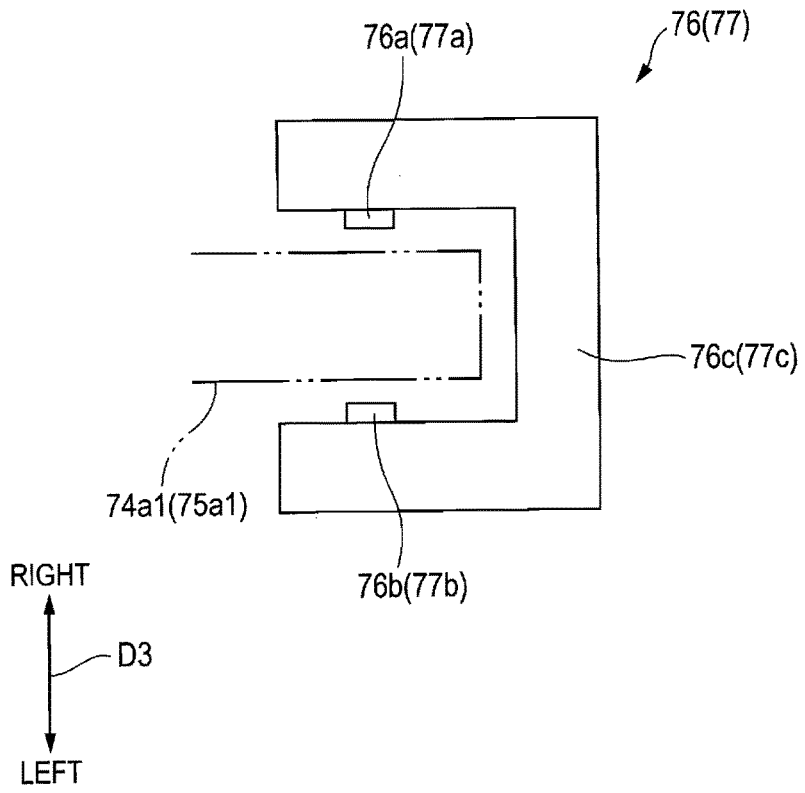
FIG. 5 is a schematic plan view of the sensor(s)

As shown in FIG. 3 and FIGS. 4A and 4B, the two sensors 76 and 77 are arranged to be shifted a little from each other in the left-right direction D3 and in the upper-lower direction D1 and arranged in almost the same position in terms of the front-rear direction D2. As shown in FIG. 5, the two sensors 76 and 77 are transmission-type optical sensors which have, respectively, light-emitting elements 76*a* and 77*a* such as light-emitting diodes (LED) or the like, light-receiving elements 76*b* and 77*b* such as phototransistors or the like, and casings 76*c* and 77*c*. Because the two sensors 76 and 77 have the same configuration, only the sensor 76 will be explained.

As shown in FIG. 5, both of the light-emitting element 76*a* and the light-receiving element 76*b* are fixed to the casing 76*c* and are arranged to face each other at a particular interval in the left-right direction D3. The casing 76*c* has a squared U-shape. The light-emitting element 76*a* is provided on the right wall of the casing 76*c* and arranged to radiate light to the left side. The light-receiving element 76*b* is provided on the left wall of the casing 76*c* and arranged to receive the light radiated from the light-emitting element 76*a*. In this manner, the light-emitting element 76*a* and the light-receiving element 76*b* are arranged on the squared U-shape casing 76*c* to face each other at a particular interval in the left-right direction D3. The interference portion 74*a*1 of the actuator 74 is configured to enter the space (the optical path of the sensor 76) between the light-emitting element 76*a* and the light-receiving element 76*b* of the sensor 76. If the interference portion 74*a*1 enters the optical path of the sensor 76 to block the light from the light-emitting element 76*a* to the light-receiving element 76*b*, then the sensor 76 is turned into an "ON state", and the sensor 76 outputs a signal indicating the ON state to the controller 180. If the interference portion 74*a*1 retreats from the optical path of the sensor 76 such that the light-receiving element 76*b* receives the light from the light-emitting element 76*a*, then the sensor 76 is turned into an "OFF state", and the sensor 76 outputs a signal indicating the OFF state to the controller 180.

Further, similar to the sensor 76, the sensor 77 has a light-emitting element 77*a* and a light-receiving element 77*b*. The light-emitting element 77*a* and the light-receiving element 77*b* are also arranged on the squared U-shape casing 76*c* to face each other at a particular interval in the left-right direction D3. The interference portion 75*a*1 of the actuator 75 is configured to enter the space (the optical path of the sensor 77) between the light-emitting element 77*a* and the light-receiving element 77*b* of the sensor 77. If the interference portion 75*a*1 enters the optical path of the sensor 77 to block the light from the light-emitting element 77*a* to the light-receiving element 77*b*, then the sensor 77 is turned into the "ON state", and the sensor 77 outputs a signal indicating the ON state to the controller 180. If the interference portion 75*a*1 retreats from the optical path of the sensor 77 such that the light-receiving element 77*b* receives the light from the light-emitting element 77*a*, then the sensor 77 is turned into the "OFF state", and the sensor 77 outputs a signal indicating the OFF state to the controller 180.

In this manner, the sensor 76 is in the "ON state" when the actuator 74 interferes with the sensor 76, and is in the "OFF state" when the actuator 74 does not interfere with the sensor 76. Similarly, the sensor 77 is in the "ON state" when the actuator 75 interferes with the sensor 77, and is in the "OFF state" when the actuator 75 does not interfere with the sensor 77. Further, the sensors 76 and 77 output the different signals between the ON state and the OFF state.

As shown in FIG. 4B, the two sensors 76 and 77 and the two support shafts 72*b*1 and 72*b*2 are arranged at an angle θ1 and an angle θ2 different from each other (the angle θ1 is larger than the angle θ2), respectively. The angle θ1 is formed between a virtual line segment L3 passing through the light-emitting element 76*a* (or the light-receiving element 76*b*) of the sensor 76, and a virtual horizontal plane H1 passing through the support shaft 72*b*1 (a plane parallel to the surface of the paper 12 stacked on the paper feeding tray 21). The angle θ2 is formed between a virtual line segment L4 passing through the light-emitting element 77*a* (or the light-receiving element 77*b*) of the sensor 77, and a virtual horizontal plane H2 passing through the support shaft 72*b*2. This realizes a configuration of mutually different volumes of the paper 12 for switching the state of the sensor 76 and switching the state of the sensor 77.

As shown in FIG. 4B, the two support shafts 72*b*1 and 72*b*2 supporting the actuators 74 and 75 are arranged to be shifted from each other in the upper-lower direction D1. This realizes a configuration of mutually different volumes of the paper 12 for switching between the ON state and the OFF state of the sensor 76 and switching between the ON state and the OFF state of the sensor 77.

Here, referring to FIGS. 6A and 6B to FIG. 9, description will be made on switching the states of the two sensors 76 and 77 along with the operations of the two actuators 74 and 75.

Figure 6A:
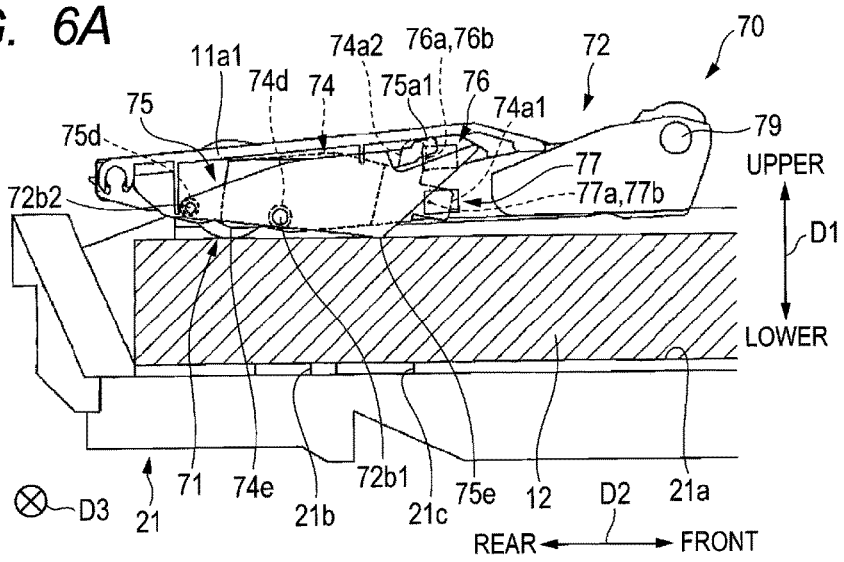
FIG. 6A is a schematic view showing a positional relationship between the two actuators and the two sensors when a paper volume of a paper feeding tray is a particular volume A1.
Figure 6B:
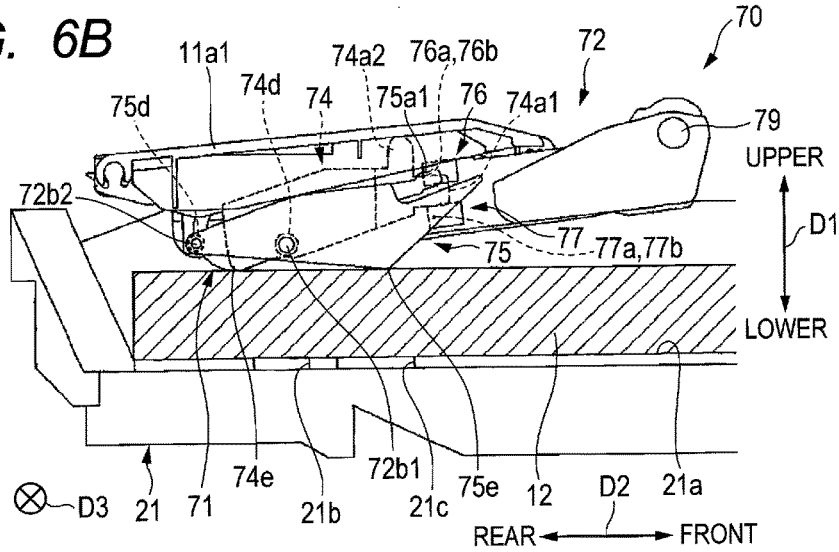
FIG. 6B is a schematic lateral view showing the positional relationship between the two actuators and the two sensors when the paper volume of the paper feeding tray is a particular volume A2 plus one sheet.

The paper feeding tray 21 of this embodiment accommodates, for example, 250 sheets of A4-size plain paper at the maximum. The arm 72 swings counterclockwise by an amount corresponding to one sheet of paper as the remaining paper 12 decreases such that the paper feed roller 71 is arranged in the position contacting the uppermost sheet of the paper 12. As shown in FIG. 6A, if a particular volume A1 (an example of first volume) of the paper 12 equivalent to 250 sheets is stacked on the paper feeding tray 21, then the contact portion 74*a*2 of the actuator 74 contacts the frame 11*a*1 supporting an inner guide member 19 such that the actuator 74 is maintained in a state where the contact portion 74*e* is separated from the paper 12. Further, at this time, the interference portion 74*a*1 of the actuator 74 is in a state of having retreated downward from the optical path of the sensor 76. That is, the sensor 76 is in the "OFF state". If the paper volume is the particular volume A1, then the actuator 75 does not contact the frame 11*a*1 but, because of being urged by the coil spring 75*d* clockwise (in the arrow F2 direction in FIG. 4A), the contact portion 75*e* contacts the uppermost sheet of the paper 12 from above. At this time, the interference portion 75*a*1 of the actuator 75 is in a state of having retreated upward from the optical path of the sensor 77. That is, the sensor 77 is in the "OFF state".

The actuator 74 is displaced downward as a whole by a displacement of the support shaft 72*b*1 along with the swing of the arm 72. The contact portion 74*a*2 of the actuator 74 contacts the frame 11*a*1 when the paper volume of the paper feeding tray 21 is between the particular volume A1 (see FIG. 6A) and the volume larger than a particular volume A2 (an example of second volume, 150 sheets for example) by one sheet (151 sheets for example; see FIG. 6B). Therefore, the actuator 74 swings counterclockwise (in the arrow F1 direction in FIG. 4A) while being restrained from free swing. Then, if the paper volume of the paper feeding tray 21 becomes the volume larger than the particular volume A2 by one sheet, then the contact portion 74*e* comes to contact with the paper 12. When the paper volume of the paper feeding tray 21 is the volume larger than the particular volume A2 by one sheet, the actuator 74 keeps the state that the interference portion 74*a*1 has retreated downward from the optical path of the sensor 76. That is, the sensor 76 is kept in the "OFF state". In this manner, if the paper volume of the paper feeding tray 21 is smaller than or equal to the particular volume A1 and larger than the particular volume A2, the contact portion 74*a*2 contacts the frame 11*a*1 and the sensor 76 keeps in the "OFF state". On the other hand, in a state where the contact portion 75*e* is in contact with the paper 12, the actuator 75 swings clockwise, that is, in the opposite direction from the arm 72 while being displaced downward as a whole by the displacement of the support shaft 72*b*2 along with the swing of the arm 72. When the paper volume of the paper feeding tray 21 becomes the volume larger than the particular volume A2 by one sheet, then the actuator 75 keeps the state that the interference portion 75*a*1 has retreated upward from the optical path of the sensor 77 (see FIG. 6B). That is, the sensor 77 is kept in the "OFF state". In this manner, the actuators 74 and 75 are configured to respectively assume swing postures such that the corresponding sensors 76 and 77 may be in the "OFF state" (to be referred to below as "first postures B1 and C1) with respect to the arm 72, if the paper volume of the paper feeding tray 21 is larger than the particular volume A2.

Figure 7A:
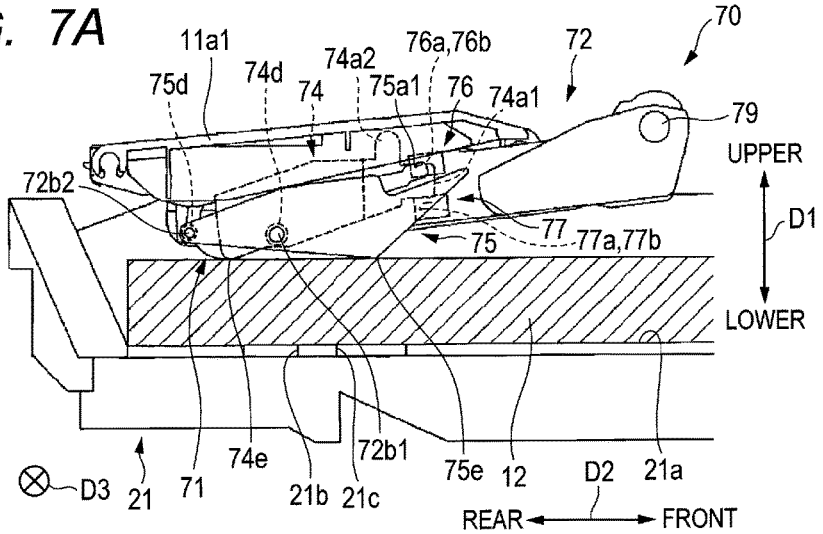
FIG. 7A is a schematic view showing the positional relationship between the two actuators and the two sensors when the paper volume of the paper feeding tray is the particular volume A2.
Figure 7B:
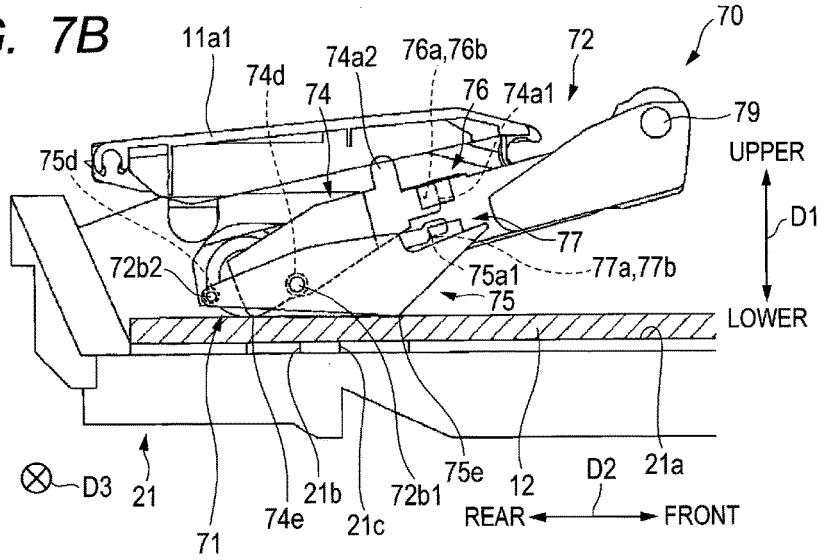
FIG. 7B is a schematic view showing the positional relationship between the two actuators and the two sensors when the paper volume of the paper feeding tray is a particular volume A3 plus one sheet.
Figure 8A:
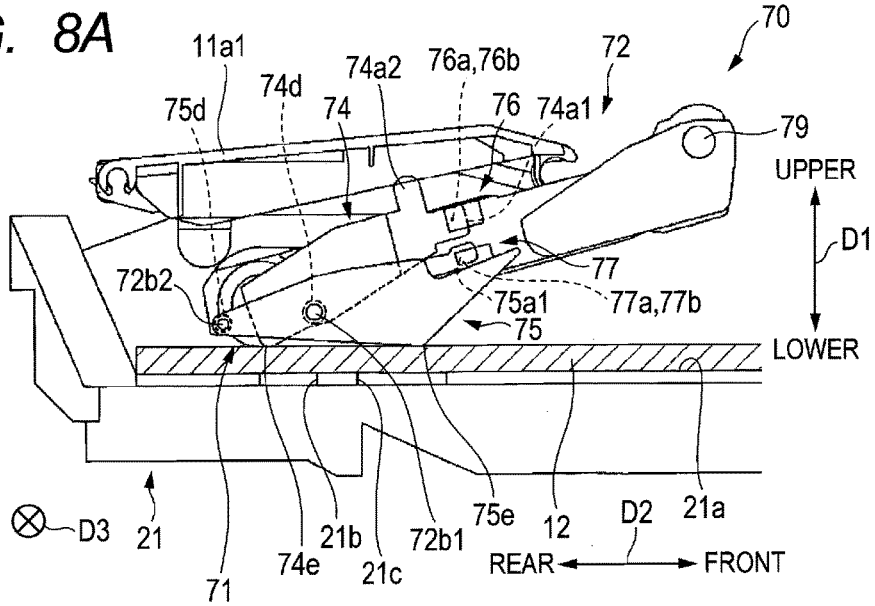
FIG. 8A is a schematic view showing the positional relationship between the two actuators and the two sensors when the paper volume of the paper feeding tray is the particular volume A3.
Figure 8B:
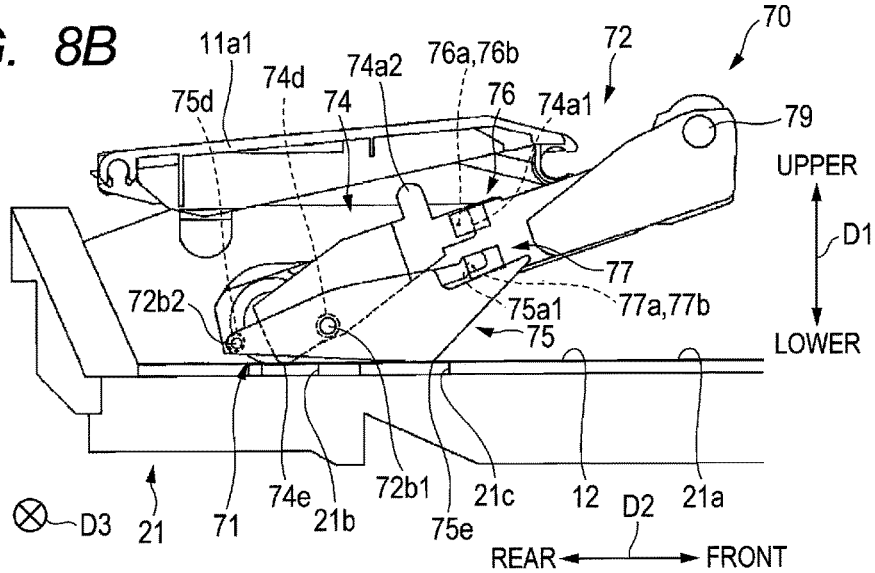
FIG. 8B is a schematic lateral view showing the positional relationship between the two actuators and the two sensors when the paper volume of the paper feeding tray is a particular volume A4.

Subsequently, if the remaining paper 12 further decreases, then the actuator 74 is further displaced downward as a whole by the displacement of the support shaft 72*b*1 along with the swing of the arm 72. As shown in FIG. 7A, when the paper volume of the paper feeding tray 21 becomes the particular volume A2, the contact portion 74*a*2 of the actuator 74 is separated from the frame 11*a*1. Therefore, when the paper volume of the paper feeding tray 21 is smaller than or equal to the particular volume A2, the actuator 74 is released from the restraint by the contact portion 74*a*2 so as to swing counterclockwise. When the paper volume of the paper feeding tray 21 is the particular volume A2, the actuator 74 is in a state that the interference portion 74*a*1 has entered the optical path of the sensor 76. That is, the sensor 76 is switched into the "ON state". Then, until the paper volume of the paper feeding tray 21 decreases to the volume larger than a particular volume A3 (an example of third volume, 50 sheets for example) by one sheet (51 sheets for example; see FIG. 7B), the actuator 74 keeps the state that the interference portion 74*a*1 has entered the optical path of the sensor 76. That is, the sensor 76 is kept in the "ON state". On the other hand, the actuator 75 swings clockwise while being displaced downward as a whole by the displacement of the support shaft 72*b*2 along with the swing of the arm 72. When the paper volume of the paper feeding tray 21 is between the volume larger than the particular volume A2 by one sheet (see FIG. 6B) and the volume larger than the particular volume A3 by one sheet (see FIG. 7B), the actuator 75 keeps the state that the interference portion 75*a*1 has retreated upward from the optical path of the sensor 77. That is, the sensor 77 is kept in the "OFF state". In this manner, the actuator 74 is configured to assume a swing posture with respect to the arm 72 such that the sensor 76 is in the "ON state" (to be referred to below as "second posture B2"), if the paper volume of the paper feeding tray 21 is smaller than or equal to the particular volume A2 and larger than the particular volume A3. On the other hand, at this time, the actuator 75 keeps the first posture C1 where the sensor 77 is in the "OFF state", in the same manner as when the paper volume of the paper feeding tray 21 is larger than the particular volume A2.

Then, when the remaining paper 12 further decreases, the actuator 74 swings counterclockwise while being further displaced downward as a whole by the displacement of the support shaft 72*b*1 along with the swing of the arm 72. When the paper volume of the paper feeding tray 21 is between the volume larger than the particular volume A3 by one sheet (see FIG. 7B) and a particular volume A4 (see FIG. 8B) equivalent to one sheet of paper, the actuator 74 keeps the state that the interference portion 74*a*1 has entered the optical path of the sensor 76. That is, the sensor 76 is kept in the "ON state". On the other hand, the actuator 75 further swings clockwise along with the decrease of the paper 12. When the paper volume of the paper feeding tray 21 is the particular volume A3 (see FIG. 8A), the actuator 75 is in a state that the interference portion 75*a*1 has entered the optical path of the sensor 77. That is, the sensor 77 is switched into the "ON state". Then, until the paper volume of the paper feeding tray 21 decreases to the particular volume A4 (see FIG. 8B), the actuator 75 keeps the state that the interference portion 75*a*1 has entered the optical path of the sensor 77. That is, the sensor 77 is kept in the "ON state". In this manner, if the paper volume of the paper feeding tray 21 is smaller than or equal to the particular volume A3 and larger than or equal to the particular volume A4, then in the same manner as when the paper volume of the paper feeding tray 21 is smaller than the particular volume A2 and larger than or equal to the particular volume A3, the actuator 74 keeps the second posture B2 where the sensor 76 is in the "ON state". On the other hand, the actuator 75 is configured to assume a swing posture (to be referred below as "second posture C2") where the sensor 77 is in the "ON state", with respect to the arm 72.

Figure 9:
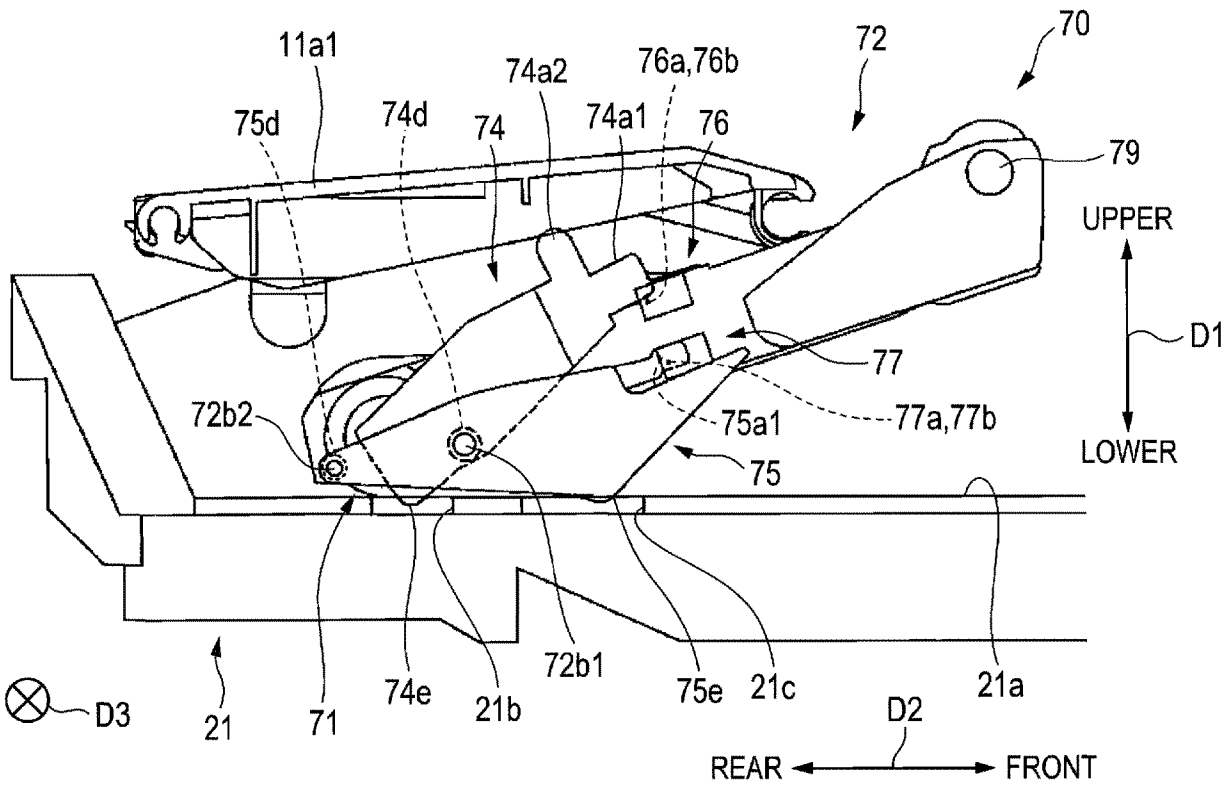
FIG. 9 is a schematic lateral view showing the positional relationship between the two actuators and the two sensors when there is no paper in the paper feeding tray.

When the paper 12 of the paper feeding tray 21 is used up, as shown in FIG. 9, the arm 72 further swings counterclockwise, and thereby the paper feed roller 71 comes to contact with the bottom surface 21*a* of the paper feeding tray 21. The actuator 74 further swings counterclockwise while being displaced downward as a whole such that contact portion 74*e* falls into a hole 21*b* formed in the bottom surface 21*a*. At this time, the actuator 74 is in the state that the interference portion 74*a*1 has retreated upward from the optical path of the sensor 76. That is, the sensor 76 is switched into the "OFF state". On the other hand, the actuator 75 further swings clockwise while being displaced downward as a whole such that the contact portion 75*e* falls into a hole 21*c* formed in the bottom surface 21*a*. At this time, the actuator 75 keeps the state that the interference portion 75*a*1 has entered the optical path of the sensor 77. That is, the sensor 77 is kept in the "ON state". In this manner, the actuator 74 is configured to assume a swing posture where the sensor 76 is in the "OFF state" (to be referred to below as "third posture B3") with respect to the arm 72, if there is no paper 12 in the paper feeding tray 21. As described above, the interference portion 74*a*1 is in opposite positions with respect to the sensor 76 between the first posture B1 and the third posture B3. On the other hand, the actuator 75 at this time keeps the second posture C2 where the sensor 77 is in the "ON state", in the same manner as when the paper volume of the paper feeding tray 21 is smaller than or equal to the particular volume A3 and larger than or equal to the particular volume A4. When the paper 12 of the paper feeding tray 21 decreases from one sheet to zero sheets, the actuator 74 switches its swing posture from the second posture B2 to the third posture B3, while only the sensor 76 switches from the "ON state" to the "OFF state". Therefore, it is possible to detect the state that the paper 12 in the paper feeding tray 21 is zero.

Here, when the paper volume of the paper feeding tray 21 is the particular volume A1, the actuators 74 and 75 (an example of contact member) are in a first state. When the paper volume is smaller than the particular volume A1 and larger than the particular volume A2, the actuators 74 and 75 are shifting from the first state to a second state. When the paper volume of the paper feeding tray 21 is the particular volume A2, the actuators 74 and 75 are in the second state. When the paper volume is smaller than the particular volume A2 and larger than the particular volume A3, the actuators 74 and 75 are shifting from the second state to a third state. When the paper volume of the paper feeding tray 21 is the particular volume A3, the actuators 74 and 75 are in the third state. When the paper volume is smaller than the particular volume A3 and larger than or equal to the particular volume A4, the actuators 74 and 75 are shifting from the third state to a fourth state. When the paper volume is empty, the actuators 74 and 75 are in the fourth state.

As shown in FIG. 2, the conveyance path 35 extends from a rear end portion of the paper feeding tray 21. The conveyance path 35 includes a curved conveyance path 33 and a linear conveyance path 34. The curved conveyance path 33 extends to be curved with the rear side of the printer unit 11 as its curved outer side and with the front side as its curved inner side. The linear conveyance path 34 extends in the front-rear direction D2. The paper 12 supported on the paper feeding tray 21 is conveyed frontward through the linear conveyance path 34 and then guided to the recording unit 40 after being conveyed through the curved conveyance path 33 upward to make a U-turn. The paper 12 on which an image has been recorded by the recording unit 40 is further conveyed frontward and then discharged to the discharge tray 22.

The curved conveyance path 33 is formed by an outer guide member 18 and an inner guide member 19 which face each other at a particular interval. The casing 11*a* supports the outer guide member 18 and the inner guide member 19. The inner guide member 19 is fixed on the frame 11*a*1 (see FIG. 6) arranged below the conveyance roller pair 50. The outer guide member 18 has a guide surface 18*a* forming the curved outer side of the curved conveyance path 33. The inner guide member 19 has a guide surface 19*a* forming the curved inner side of the curved conveyance path 33. The linear conveyance path 34 is formed by the recording unit 40 and the platen 42 which face each other at a particular interval.

As shown in FIG. 2, the conveyance roller pair 50 is constructed from a pair of rollers 52 and 53, and arranged on the upstream side from the recording unit 40 in the conveyance direction 15. The roller 52 is arranged below the roller 53 to contact the lower surface of the paper 12 conveyed from the curved conveyance path 33 to the linear conveyance path 34. The roller 52 is a driving roller to which a drive force is inputted from a conveyance motor 50M (see FIG. 10) to rotate the same. The roller 53 is arranged to face the roller 52 to contact the upper surface of the paper 12. The roller 53 rotates along with the rotation of the roller 52. The roller 52 and the roller 53 cooperate to nip the paper 12 from the upper-lower direction D1 to convey the same in the conveyance direction 15.

As shown in FIG. 2, the discharge roller pair 60 is constructed from a pair of rollers 62 and 63, and arranged on the downstream side from the recording unit 40 in the conveyance direction 15. The roller 62 is arranged below the roller 63 to contact the lower surface of the paper 12 conveyed through the linear conveyance path 34. The roller 62 is a driving roller to which the drive force is inputted from the conveyance motor 50M to rotate the same. The roller 63 is arranged to face the roller 62 to contact the upper surface of the paper 12. The roller 63 is a spur roller rotating along with the rotation of the roller 62. The roller 62 and the roller 63 cooperate to nip the paper 12 along the upper-lower direction D1 to convey the same in the conveyance direction 15. As a result, the paper 12 is conveyed by the discharge roller pair 60 toward the opening 13 (see FIG. 1) positioned on the downstream side in the conveyance direction 15 and then discharged to the discharge tray 22.

As shown in FIG. 2, the platen 42 is provided below the linear conveyance path 34 and between the conveyance roller pair 50 and the discharge roller pair 60. The platen 42 is a plate-like member arranged to face the recording unit 40 in the upper-lower direction D1 to support, from below, the paper 12 conveyed through the linear conveyance path 34.

As shown in FIG. 2, the recording unit 40 is arranged in a position above the linear conveyance path 34 to face the platen 42 in the upper-lower direction D1. The recording unit 40 has a carriage 41, a recording head 38, and a driving mechanism 40*a* (see FIG. 10). The carriage 41 is supported by two guide rails 45 and 46. The two guide rails 45 and 46 are arranged apart from each other in the front-rear direction D2, and each extends in the left-right direction D3. The carriage 41 is arranged to straddle on the two guide rails 45 and 46. Further, the driving mechanism 40*a* has a carriage driving motor 40M and, by the control of the controller 180, reciprocatingly moves the carriage 41 along the two guide rails 45 and 46 in the left-right direction D3 which is a main scanning direction. The recording head 38 is mounted on the carriage 41. The recording head 38 ejects ink supplied from an ink cartridge (not shown) from nozzles 39 provided in its lower surface. That is, while the carriage 41 moves in the left-right direction D3, an image is recorded on the upper surface of the paper 12 supported on the platen 42 by ejecting ink droplets from the nozzles 39 of the recording head 38 toward the platen 42.

Figure 10:
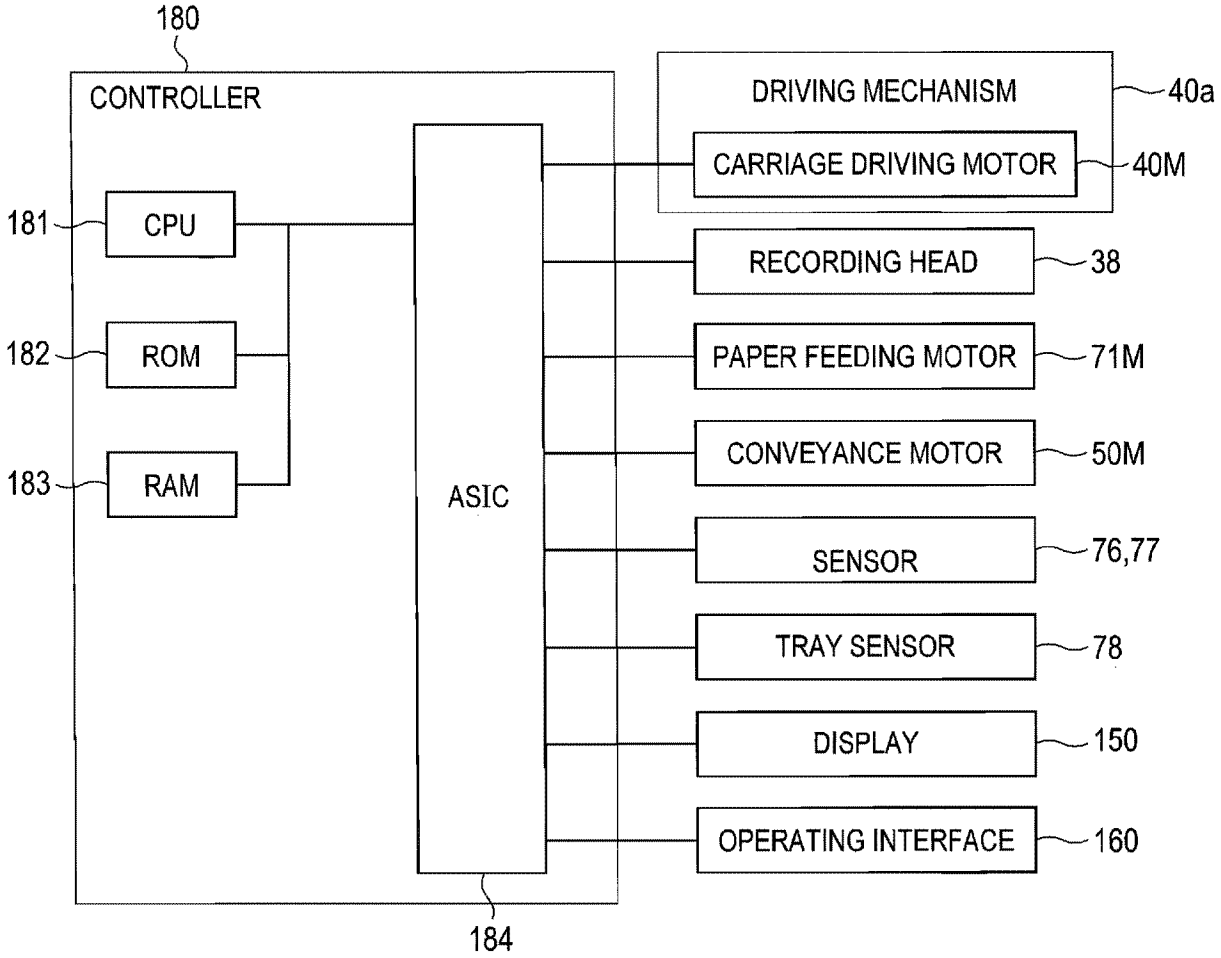
FIG. 10 is a block diagram of a controller.

As shown in FIG. 10, the controller 180 includes a CPU (Central Processing Unit) 181, a ROM (Read Only Memory) 182, a RAM (Random Access Memory) 183, an ASIC (Application Specific Integrated Circuit) 184, and so on. These components cooperate to control the operations of the carriage driving motor 40M, the recording head 38, the paper feeding motor 71M, the conveyance motor 50M, the display 150, the operating interface 160 and so on. For example, based on a record command sent from an external device such as a PC or the like, the controller 180 controls the recording head 38, the carriage driving motor 40M, the paper feeding motor 71M, the conveyance motor 50M, and so on, to record an image etc. on the paper 12.

Further, the ROM 182 stores the combination of four types of states of the two sensors 76 and 77. The combination of four types corresponds to the remaining paper state in four stages. Specifically, as shown in FIG. 11, when the sensor 76 is in the OFF state while the sensor 77 is in the ON state, the combination corresponds to no paper or being empty of paper; when the sensor 76 is in the ON state and the sensor 77 is also in the ON state, it corresponds to a near empty state; when the sensor 76 is in the ON state while the sensor 77 is in the OFF state, it corresponds to a medium volume of paper; and when the sensor 76 is in the OFF state and the sensor 77 is also in the OFF state, it corresponds to a large volume of paper. Then, based on the signals from the sensors 76 and 77, the controller 180 controls the display 150 to display the remaining volume of paper.

Further, although one CPU 181 and one ASIC 184 are shown in FIG. 10, the controller 180 may include only one CPU 181 and the one CPU 181 may collectively perform necessary processes. Alternatively, the controller 180 may include a plurality of CPUs 181 and the plurality of CPUs 181 may share the performance of necessary processes. Further, the controller 180 may include only one ASIC 184 and the one ASIC 184 may collectively perform necessary processes. Alternatively, the controller 180 may include a plurality of ASICs 184 and the plurality of ASICs 184 may share the performance of necessary processes.

Figure 12:
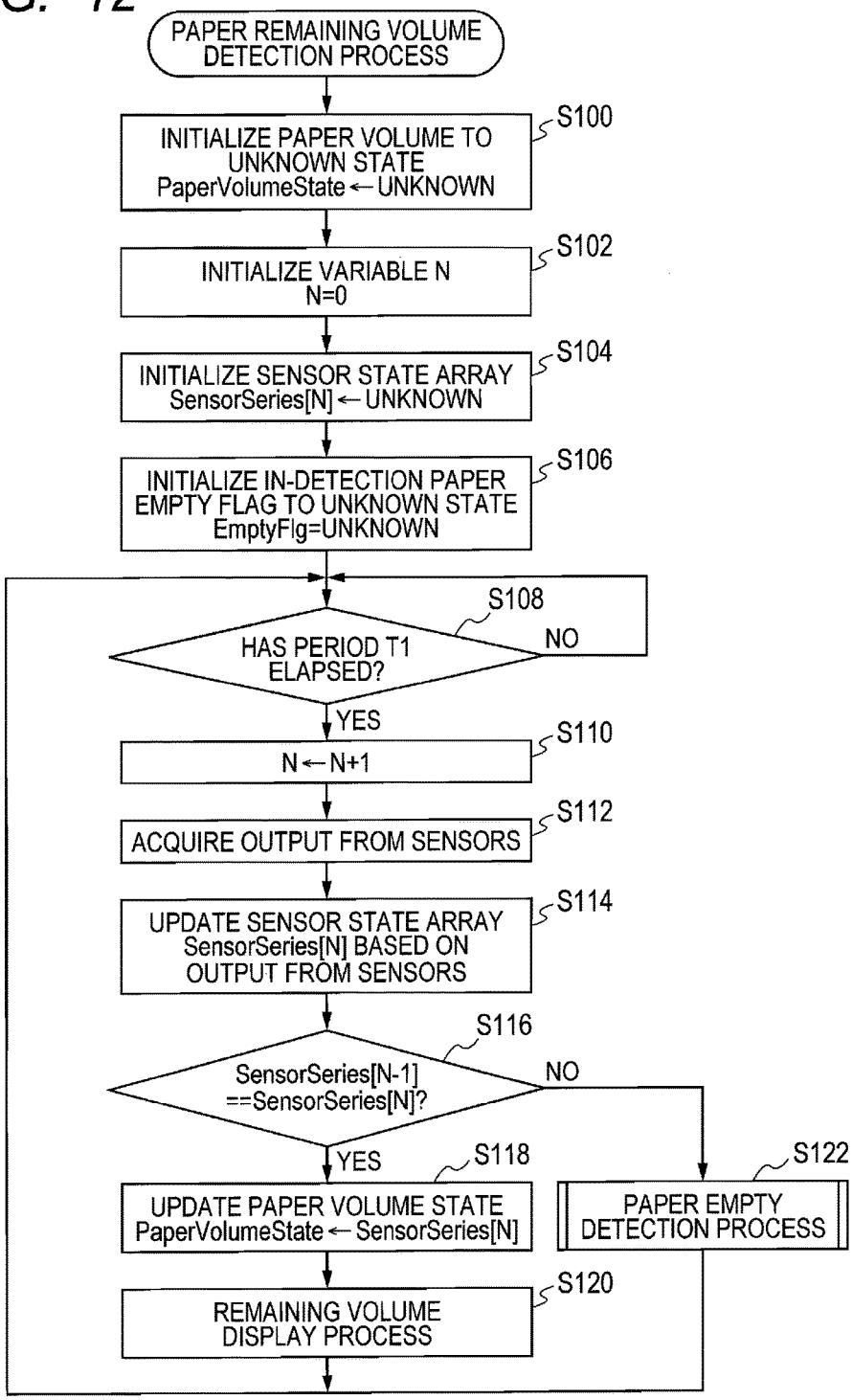
FIG. 12 is an explanatory diagram showing a flow of a paper remaining volume detection process according to a first embodiment.

Next, a paper remaining volume detection process performed by the controller 180 will be described. The paper remaining volume detection process is executed when the power source of the MFP 10 is turned ON. As shown in FIG. 12, in the paper remaining volume detection process, the CPU 180 firstly initializes a paper remaining volume state (hereinafter, simply referred to as "paper volume state") (S100). Specifically, the CPU 181 sets a variable PaperVolumeState showing the paper volume state stored in the ROM 182 to an unknown (indefinite) state UNKNOWN. The variable "PaperVolumeState" stores any of the values respectively corresponding to the four types of paper volume states (large volume, medium volume, near empty, empty) of the paper 12 stacked in the paper feeding tray 21 shown in FIG. 11. In S100, the CPU 181 sets PaperVolumeState to the unknown state. Thus, at the time point at which S100 is executed, PaperVolumeState does not store any of the values respectively corresponding to the four types of paper volume states.

Next, the CPU 181 initializes a variable N stored in the RAM 183 (S102). Specifically, the CPU 181 sets the variable N to zero.

After initializing the variable N, the CPU 181 initializes a sensor state array SensorSeries[N] (S104). Specifically, the CPU 181 sets SensorSeries[N] to an unknown state. The array "SensorSeries[N]" is an array that is stored in the ROM 182 and that is used to store a combination of output signals acquired from the sensors 76 and 77 at each particular period T1. The CPU 181 acquires, from each of the sensors 76 and 77, an output signal showing an ON state or an OFF state depending on the paper volume state, and stores, in SensorSeries[N], the acquired combinations of the output signals from the sensors 76 and 77. In S104, SensorSeries[N] is initialized to the unknown state. Thus, nothing is stored in SensorSeries[N] at the time point when S104 is executed.

Next, the CPU 181 initializes an in-detection empty flag (EmptyFlg) to an unknown state (S106). The in-detection empty flag is a flag to show whether the paper 12 is stacked in the paper feeding tray 21. If the in-detection empty flag is set (EmptyFlg=TRUE), it shows that the paper 12 is not stacked in the paper feeding tray 21. If the in-detection empty flag is reset (EmptyFlg=FALSE), then it shows that the paper 12 is stacked in the paper feeding tray 21.

Next, the CPU 181 determines whether a period T1 has elapsed since the execution of S106 (S108). The period T1 can be set appropriately and is exemplarily a particular value from 10 ms to 100 ms. The CPU 181 uses the real time clock (RTC) included in the MFP 10 for example to measure the period to thereby determine whether the period T1 has elapsed since the execution of S106. The CPU 181 waits until the period T1 elapses (S108: NO). When the CPU 181 determines that the period T1 has elapsed (S108: YES), then the CPU 181 adds one to the variable N (S110). Thereafter, the CPU 181 acquires the output signals from the sensors 76 and 77 (S112).

Next, the CPU 181 stores, in SensorSeries[N], the combination of the output signals acquired from the sensors 76 and 77 (S114). Thereafter, the CPU 181 determines whether the combination of the output signals from the sensors 76 and 77 stored in SensorSeries[N] in S114 is the same as the combination of the output signals from the sensors 76 and 77 stored in SensorSeries[N−1] as a previous sensor state array (i.e., determines whether the combination of the output signals acquired from the sensors 76 and 77 for each period T1 is the same twice successively) (S116).

When the same combination of the output signals is acquired from the sensors 76 and 77 twice successively (S116: YES), the CPU 181 updates the paper volume state (S118). Specifically, the CPU 181 refers to, based on the combination of the output signals acquired from the sensors 76 and 77, a table including the association (relationship) between the combination of the output signals from the sensors 76 and 77 and the paper volume state shown in FIG. 11. Then, the CPU 181 determines which of the four types of the paper volume states (large volume, medium volume, near empty, empty) the combination of the output signals from the sensors 76 and 77 stored in the sensor state array in S114 represents. When the CPU 181 determines which of the four types of the paper volume states the paper volume state represents, then the CPU 181 stores, in PaperVolumeState, a value corresponding to the determined paper volume state. By the above processing, the CPU 181 determines the paper volume state of the paper 12 stacked in the paper feeding tray 21.

In this embodiment, the paper volume state is detected by the actuators 74 and 75 and the sensors 76 and 77. The actuators 74 and 75 are supported by the arm 72 with the support shafts 72*b*1 and 72*b*2, respectively, in a swingable manner. Thus, when the MFP 10 receives an external force, for example, the actuators 74 and 75 are vibrated. Then, so-called chattering may be caused where the vibration causes the actuators 74 and 75 to chatter about the support shafts 72*b*1 and 72*b*2 as a fulcrum. During the occurrence of the chattering, the chattering of the actuators 74 and 75 prevents the actuators 74 and 75 from having a stable position. Thus, there is a possibility that the sensors 76 and 77 erroneously output, to the controller 180, a signal showing a paper volume state different from the actual paper volume state. In order to prevent the erroneous detecting of the paper volume state due to the chattering, in the paper remaining volume detection process in this embodiment, the paper volume state is determined only when the combination of the output signals from the sensors 76 and 77 acquired for each period T1 is the same twice successively. When the actuators 74 and 75 chatter, the sensors 76 and 77 unlikely output the same signal twice successively. The combination of the output signals from the sensors 76 and 77 that is the same twice successively means that the actuators 74 and 75 have likely a stable position. Thus, a possibility is reduced that the paper volume state is detected erroneously due to the chattering.

After updating the paper volume state in S118, the CPU 181 executes a remaining volume display process to cause the display 150 to display which of large volume, medium volume, near empty, and empty the paper volume state is (S120). By executing the remaining volume display process, if the paper volume state is near empty or empty, the user during the execution of a printing process is notified of this state, thereby allowing the user to appropriately know the timing at which the paper 12 should be replenished.

On the other hand, when the CPU 181 determines that the combination of the output signals from the sensors 76 and 77 in S116 is different from the previous combination of the output signals from the sensors 76 and 77 (i.e., the combination of the output signals from the sensors 76 and 77 is not the same twice successively) (S116: NO), the CPU 181 executes a paper empty detection process subroutine (S122), and subsequently returns to S108. The paper empty detection process subroutine will be described later. In this embodiment, the paper remaining volume detection process is always repeatedly executed during the period from the turning ON of the power source of the MFP 10 to the subsequent turning OFF of the power source. Specifically, the paper volume state is continuously updated by the paper remaining volume detection process.

Figure 13:
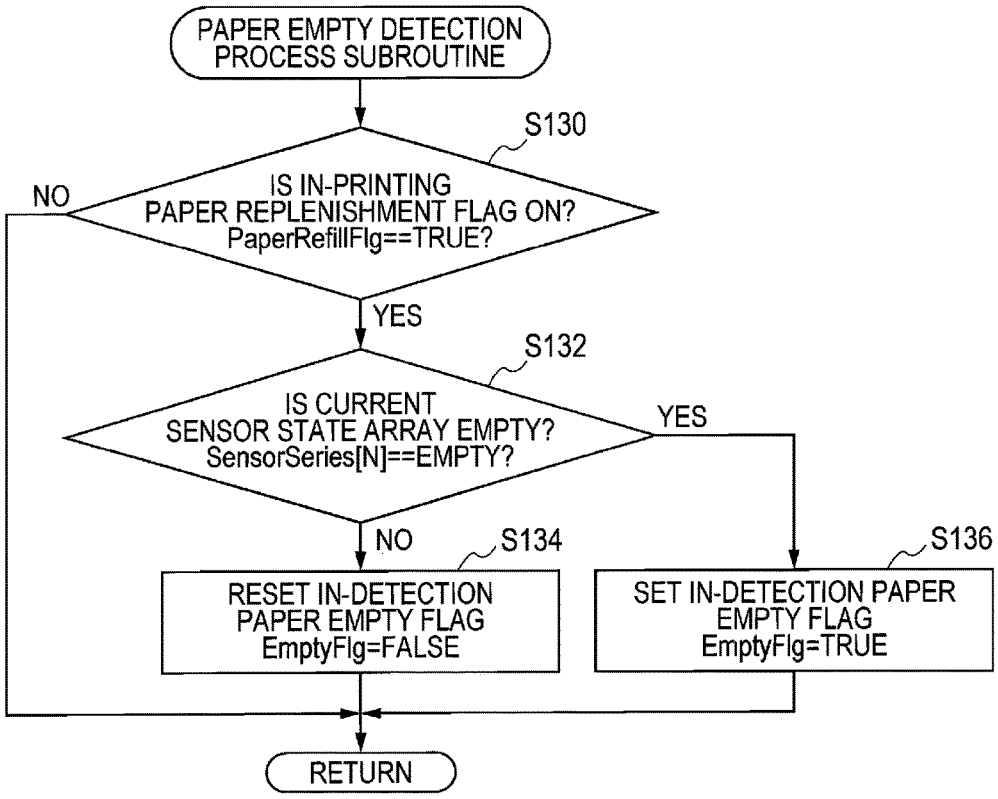
FIG. 13 is an explanatory diagram showing a flow of a paper empty detection process according to the first embodiment.

With reference to FIG. 13, the paper empty detection process subroutine will be described. In the paper empty detection process subroutine, the CPU 181 firstly determines whether an in-printing paper replenishment flag (PaperRefillFlg) is set (S130). The in-printing paper replenishment flag is a flag that is set when the sheet is replenished during the printing process. The case where the in-printing paper replenishment flag is not set (i.e., reset) corresponds to a case where the printing process is not executed and a case where the printing process is being performed but the paper volume state is other than empty and the paper is not replenished. When the CPU 181 determines that the in-printing paper replenishment flag is not set (S130: NO), the paper empty detection process subroutine is completed. Specifically, in this embodiment, the paper empty detection process subroutine is executed only when the sheet is replenished during the printing.

When it is determined that the in-printing paper replenishment flag is set (S130: YES), the CPU 181 determines whether the latest combination of the output signals from the sensors 76 and 77 stored in the sensor state array shows empty or the paper volume state other than empty (large volume, medium volume, near empty) (S132). When the latest combination of the output signals from the sensors 76 and 77 stored in the sensor state array shows empty (S132: YES), the CPU 181 sets the in-detection empty flag (S136). When the CPU 181 determines that the latest combination of the output signals from the sensors 76 and 77 stored in the sensor state array shows the paper volume state other than empty (S132: NO), the CPU 181 resets the in-detection empty flag (S134). Thereafter, the paper empty detection process subroutine is completed. As described above, when the in-detection empty flag is set, it means that no paper 12 is stacked in the paper feeding tray 21. When the in-detection empty flag is reset, it means that the paper 12 is stacked in the paper feeding tray 21.

In this embodiment, as shown in FIG. 9, in the empty state in which no paper 12 is stacked in the paper feeding tray 21, the contact portion 74*e* of the actuator 74 and the contact portion 75*e* of the actuator 75 enter the holes 21*b* and 21*c* provided in the bottom surface 21*a* of the paper feeding tray 21, respectively. When the MFP 10 receives the external force for example and when the paper volume state is other than empty (i.e., when the paper 12 is stacked in the paper feeding tray 21), the actuators 74 and 75 are vibrated due to chattering when the contact portions 74*e* and 75*e* contact the paper 12, thus the chattering does not stop quickly. When the paper volume state is empty, the contact portions 74*e* and 75*e* of the actuators 74 and 75 enter the holes 21*b* and 21*c*, and do not contact the paper 12 or the bottom surface 21*a* of the paper feeding tray 21, thereby suppressing the actuators 74 and 75 from chattering. In this embodiment, the coil spring 74*d* and the coil spring 75*d* are used to urge the contact portions 74*e* and 75*e* toward the bottom surface 21*a* of the paper feeding tray 21. Thus, when the paper volume state is empty, the actuators 74 and 75 have the third posture B3 and the second posture C2 shown in FIG. 9 in a more stable manner. As described above, when the paper volume state is empty, the actuators 74 and 75 have the stable postures shown in FIG. 9. This reduces, when the paper volume state is empty, a possibility that the sensors 76 and 77 output a signal showing the paper volume state other than empty even when the MFP 10 receives the external force. Thus, the empty state can be detected reliably.

As described above, when the paper volume state is empty, the sensors 76 and 77 unlikely output a signal showing the paper volume state other than empty. Thus, when it is determined in S132 that the latest combination of the output signals from the sensors 76 and 77 stored in the sensor state array shows a state other than empty (S132: NO), it is likely that the paper volume state is other than empty (i.e., it is likely that the paper 12 is stacked in the paper feeding tray 21). Thus, when it is determined in S132 that the latest combination of the output signals from the sensors 76 and 77 stored in sensor state array shows a state other than empty (S132: NO), the CPU 181 resets the in-detection empty flag (S134) and determines that the paper 12 is stacked in the paper feeding tray 21. When it is determined that the latest combination of the output signals from the sensors 76 and 77 stored in the sensor state array shows empty (S132: YES), it is highly likely that the paper volume state is empty. Thus, the CPU 181 sets the in-detection empty flag (S136) and determines that no paper 12 is stacked in the paper feeding tray 21. By executing the paper empty detection process subroutine as described above, the CPU 181 determines whether the paper 12 is stacked in the paper feeding tray 21 before the detection of the paper volume state is completed.

Figure 14:
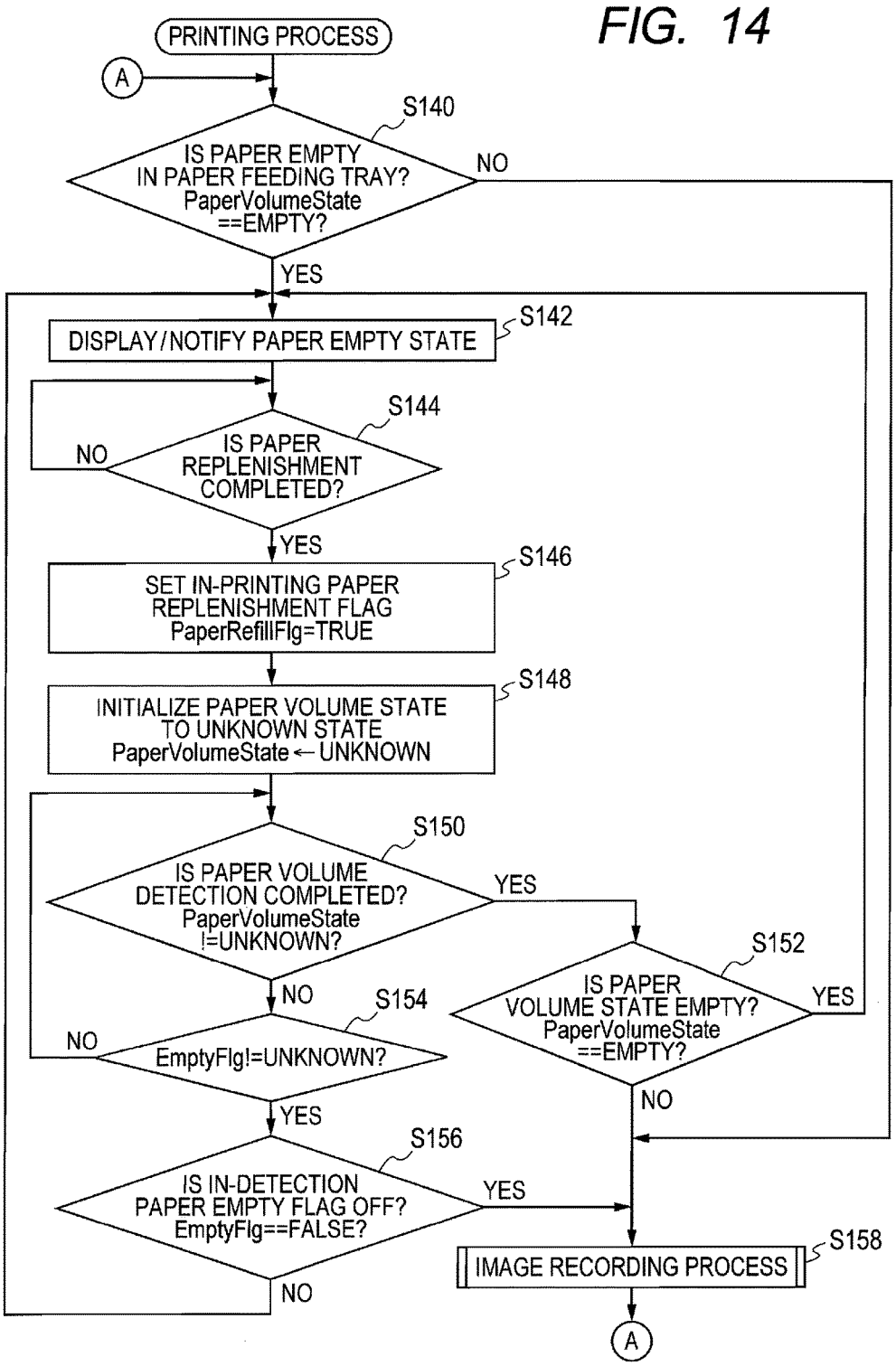
FIG. 14 is an explanatory diagram showing a flow of a printing process according to the first embodiment.
Figure 15:
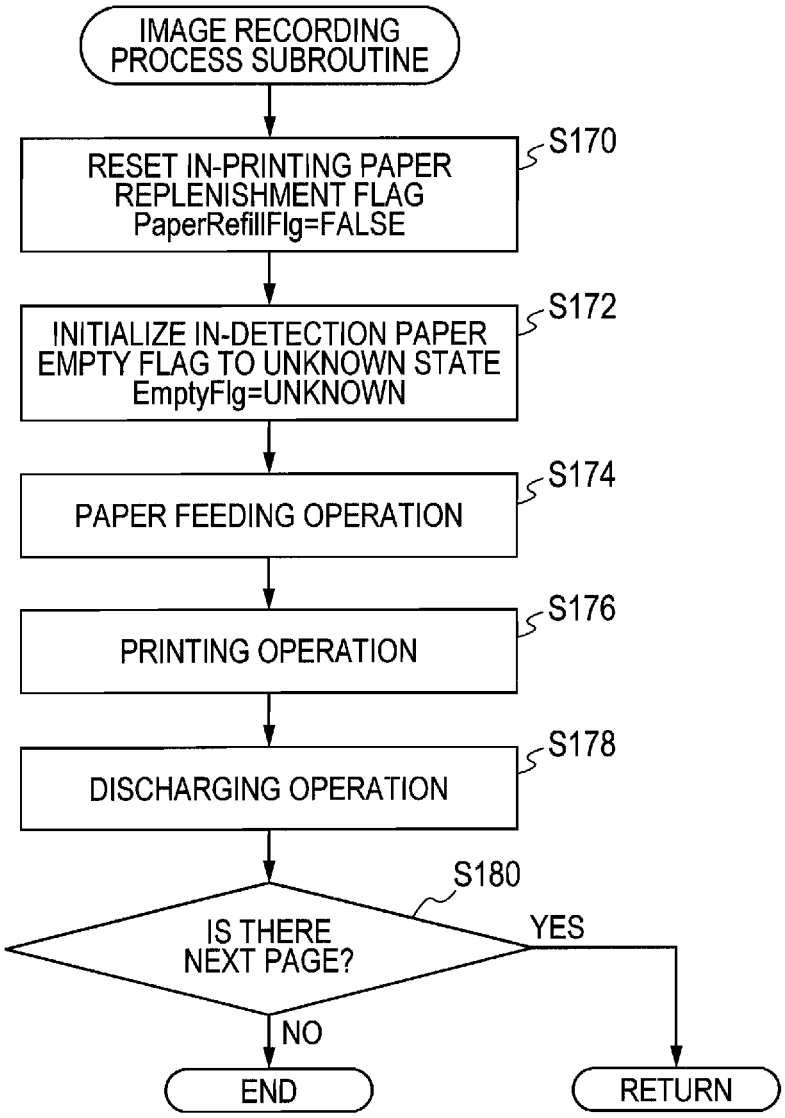
FIG. 15 is an explanatory diagram showing a flow of the printing process according to the first embodiment.

Next, with reference to FIG. 14 and FIG. 15, a printing process executed by the MFP 10 will be described. In the printing process, upon receiving the print data, the CPU 181 firstly refers to the value stored in PaperVolumeState and determines whether the paper volume state is empty or a state other than empty (S140). When it is determined that the paper volume state is a state other than empty (i.e., the paper 12 is stacked in the paper feeding tray 21) (S140: NO), the CPU 181 executes an image recording process subroutine (S158). The image recording process subroutine will be described later.

When it is determined that the paper volume state is empty (i.e., no paper 12 is stacked in the paper feeding tray 21) (S140: YES), the CPU 181 controls the display 5 to display that the paper volume state is empty and to display a message prompting a paper replenishment (refill) operation such as "please remove the paper feeding tray and replenish paper" to notify the user of the necessity of the paper replenishment operation (S142). Thereafter, the CPU 181 continues the processing of S142 until the user completes the paper replenishment operation (S144: NO). When it is determined that the paper replenishment operation by the user is completed (S144: YES), the in-printing paper replenishment flag is set (S146). Then, as in the processing of S100, the paper volume state is initialized (S148). The CPU 181 uses, in S144, the tray sensor 78 (an example of detector) for detecting the insertion and removal of the paper feeding tray 21 for example (see FIG. 10) to detect that the paper feeding tray 21 is removed from the MFP 10 and then the paper feeding tray 21 is mounted onto the MFP 10. When this is detected, then the CPU 181 determines that the paper replenishment operation by the user is completed. Alternatively, the user may manually input the completion of the paper replenishment operation through the operating interface 160, and the CPU 181 may determine that the paper replenishment operation is completed based on the operation input result by the user. The tray sensor 78 is a known tray sensor and will not be described further.

After initializing the paper volume state (S148), the CPU 181 determines whether the paper volume state has been detected in the paper remaining volume detection process shown in FIG. 12 (S150). Specifically, the CPU 181 determines whether the combination of the output signals acquired from the sensors 74 and 75 in S116 is the same twice successively (S116: YES) and whether the PaperVolumeState has been updated (S118). When it is determined in S144 that the paper replenishment operation is completed, it is highly likely that the paper feeding tray 21 is mounted on the MFP 10 by the user. When the paper feeding tray 21 is mounted onto the MFP 10, the MFP 10 receives external force caused by mounting of the paper feeding tray 21, which causes a state where the actuators 74 and 75 tend to be vibrated and chattered. Thus, for a while after the paper replenishment operation is completed by the user, the chattering prevents the actuators 74 and 75 from having a stable position, thus causing a possibility that a long period is required for the paper volume state to be detected. When the CPU 181 in S150 determines that the detection of the paper volume state is not yet completed (S150: NO), the processing proceeds to S154. A fact that the detection of the paper volume state is not yet completed means it is highly likely that the chattering is occurring and the positions of the actuators 74 and 75 are not stabilized yet.

In S154, the CPU 181 determines whether the in-detection empty flag is set or reset in the paper empty detection process subroutine. When the CPU 181 determines that the in-detection empty flag is still in the unknown state (S154: NO), the processing returns to S150. When the CPU 181 determines that the in-detection empty flag is not in the unknown state (S154: YES), the CPU 181 determines whether the in-detection empty flag is set or reset (S156). When it is determined in the paper empty detection process subroutine that the in-detection empty flag is reset (S156: YES), it means as described above it is determined that the paper 12 is stacked in the paper feeding tray 21. Thus, the CPU 181 executes the image recording process subroutine without waiting for the completion of the detection of the paper volume state (S158). When it is determined in the paper empty detection process subroutine that the in-detection empty flag is set (S156: NO), it means that no paper 12 is stacked in the paper feeding tray 21 as described above. Thus, the processing returns to S142.

When it is determined in S150 that the detection of the paper volume state is completed (S150: YES), then the CPU 181 determines whether the paper volume state is empty (i.e., whether the sheet is replenished in the paper feeding tray 21) (S152). The completion of the detection of the paper volume state in S150 means that no chattering is caused after the paper replenishment operation or that the vibration of the actuators 74 and 75 is small and thus the actuators 74 and 75 have a stable posture in a relatively quick manner and thus the detection of the paper volume state has been completed quickly. When the CPU 181 determines that the paper volume state is empty (S152: YES), the processing returns to S142. The determination of "YES" in S152 means that the user has removed the paper feeding tray 21 and subsequently mounted the paper feeding tray 21 onto the MFP 10 without replenishing the paper 12 or that the user has inputted the completion of the paper replenishment operation through the operating interface 160 although the paper replenishment operation is not yet completed, for example. When the CPU 181 determines in S152 that the paper volume state is other than empty (S152: NO), the CPU 181 executes the image recording process subroutine (S158).

Next, with reference to FIG. 15, the image recording process subroutine will be described. In the image recording process subroutine, the CPU 181 firstly resets the in-printing paper replenishment flag (S170) and initializes, as in S106, the in-detection empty flag to the unknown state (S172). Thereafter, the CPU 181 drives the feeding motor 71M, the conveyance motor 50M, and the carriage driving motor 40M to perform a paper feeding operation (S174), a printing operation (S176), or a paper discharging operation (S178). Then, it is determined whether the next page exists (S180). When it is determined that the next page exists (S180: YES), the image recording process subroutine is completed and the processing returns to S140. When it is determined that the next page does not exist in S180 (S180: NO), the printing process is completed.

Effect of the Embodiment

According to this embodiment, the CPU 181 detects the paper volume state of the paper 12 stacked in the paper feeding tray 21 based on the combination of the output signals acquired from the sensors 76 and 77. In the paper empty detection process subroutine, the CPU 181 determines that the paper 12 is stacked in the paper feeding tray 21 on condition that an output signal showing the paper volume state other than empty is acquired at least one time from the sensors 76 and 77 prior to the detection of the paper volume state, and executes the paper feeding process.

By doing so, the paper 12 stacked in the paper feeding tray 21 can be detected by a smaller number of times than the number of times the output signals from the sensors 76 and 77 are acquired for detecting the paper volume state. Thus, when compared with a case where the paper feeding process is executed after the paper volume state is detected, a period required for executing the paper feeding process can be reduced, and the paper feeding process can be executed promptly.

According to this embodiment, in the paper empty detection process subroutine, the CPU 181 determines that the paper 12 is stacked in paper feeding tray 21 when an output signal showing the paper volume state other than empty is acquired at least once from the sensors 76 and 77, and executes the paper feeding process. This consequently reduces a period required for detecting that the paper 12 is stacked in the paper feeding tray 21, thus the paper feeding process can be executed promptly.

According to this embodiment, in the paper remaining volume detection process, when the combination of the output signals acquired from the sensors 76 and 77 at each period T1 is the same twice successively, the CPU 181 determines the paper volume state based on the acquired combination of the output signals from the sensors 76 and 77. This consequently reduces a possibility that the paper volume state is erroneously detected when the chattering prevents the actuators 74 and 75 from having a stable position, and the paper volume state can be detected promptly.

According to this embodiment, the CPU 181 determines whether the paper 12 is stacked in the paper feeding tray 21 only when the paper volume state becomes empty during the printing process. When the paper volume state is other than empty (S140: NO), the CPU 181 executes the image recording process (S158) without executing the paper remaining volume detection process (S142 to S152). This consequently suppresses the CPU 181 from executing unnecessary processing, thus reducing the period required to complete the printing process.

According to this embodiment, the CPU 181 determines whether the paper 12 is stacked in the paper feeding tray 21 only when the paper volume state becomes empty during the printing and subsequently the paper replenishment operation by the user is completed (S144: YES). Thus, the stacking determination processing can be executed at a timing at which the chattering is likely to be caused when the replenishment operation of the paper 12 by the user is completed. Thus, the paper feeding process can be restarted promptly after the replenishment operation of the paper 12 is performed by the user. Thus, a printing period can be reduced.

According to this embodiment, it is determined whether the paper replenishment operation by the user is completed, by using the tray sensor 78. Thus, the completion of the paper replenishment operation can be determined without causing a burden on the user.

While the disclosure has been described in detail with reference to the above aspects thereof, it would be apparent to those skilled in the art that various changes and modifications may be made therein without departing from the scope of the claims. In the following descriptions, like parts and components are designated by the same reference numerals to avoid duplicating description.

Modification 1

Figure 16:
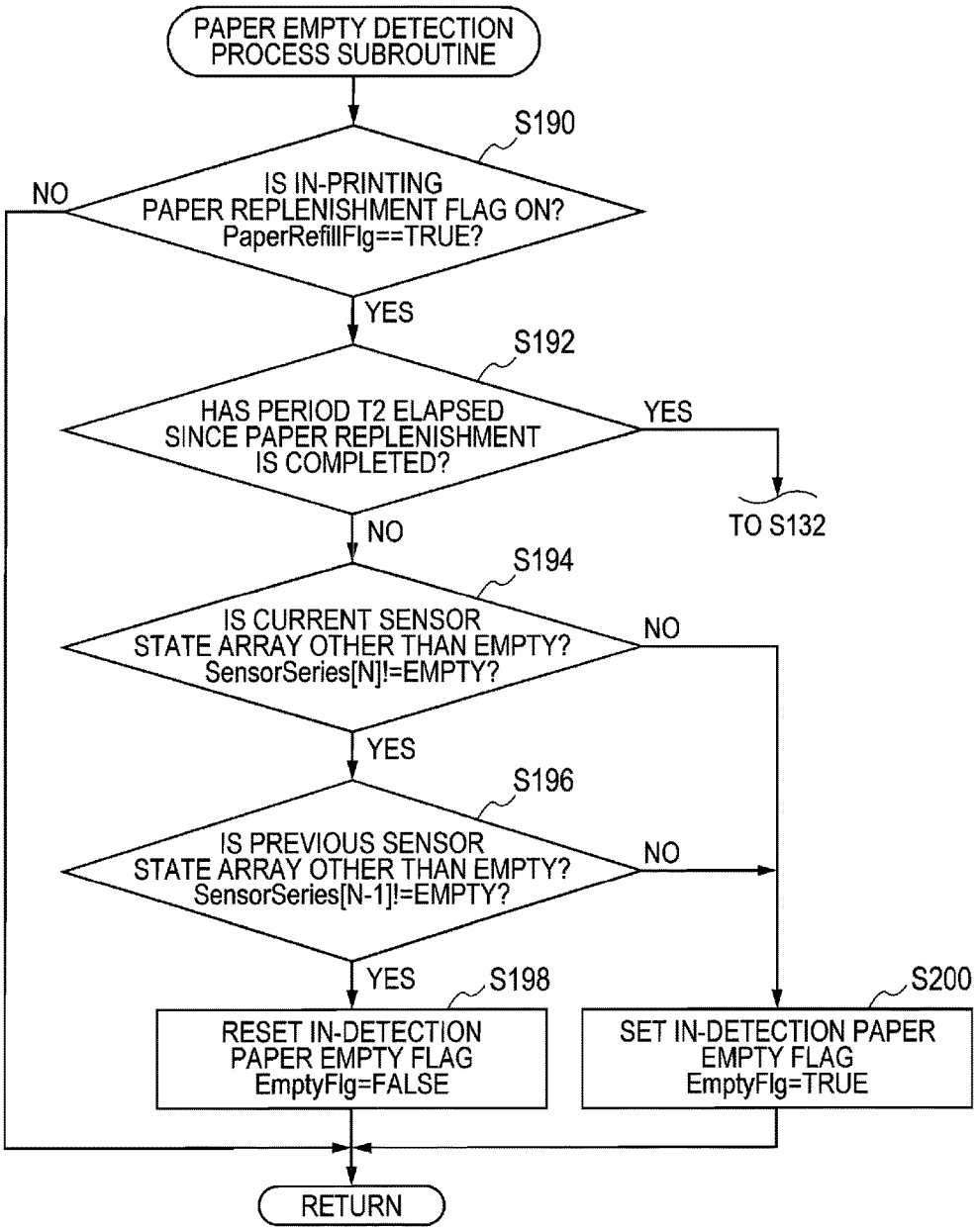
FIG. 16 is an explanatory diagram showing a subroutine of a paper empty detection process according to a modification.

With reference to FIG. 16, a modification of the paper empty detection process subroutine will be described. In the paper empty detection process subroutine of the modification, the CPU 181 firstly determines whether the in-printing paper replenishment flag is set (S190). When it is determined that the in-printing paper replenishment flag is set (S190: YES), the CPU 181 determines whether a period T2 has elapsed since the paper replenishment operation by the user is completed (S192). The period T2 is a time period required for the actuators 74 and 75 to have a stable posture, when the paper volume state is empty after the paper replenishment operation by the user is completed. This period is experimentally set by repeating try and error operations prior to the shipment, for example. When the CPU 181 determines that the period T2 has elapsed since the paper replenishment operation is completed (S192: YES), the processing proceeds to S132. When it is determined that the period T2 has not elapsed since the paper replenishment operation is completed (S192: NO), the CPU 181 determines whether the combination of the output signals acquired from the sensors 76 and 77 shows the paper volume state other than empty twice successively (S194, S196). When it is determined that the combination of the output signals acquired from the sensors 76 and 77 shows the paper volume state other than empty twice successively (S194: YES and S196: YES), the CPU 181 resets the in-detection empty flag (S198). When it is determined that the combination of the output signals acquired from the sensors 76 and 77 does not show the paper volume state other than empty twice successively (S194: NO or S196: NO), the CPU 181 sets the in-detection empty flag (S200).

When the actuators 74 and 75 are vibrated significantly, the actuators 74 and 75 may take a long time to have a stable posture, even when the paper volume state is empty. This causes a possibility that the sensors 74 and 75 output a signal showing the paper volume state other than empty. In the modification 1, when the paper volume state is empty after the paper replenishment operation by the user is completed, until the period T2 required for the actuators 74 and 75 to have a stable posture elapses (that is, as long as there is a possibility that the actuators 74 and 75 may chatter even in the empty state), the CPU 181 determines that the paper 12 is stacked in the paper feeding tray 21 in response to determining that the combination of the output signals acquired from the sensors 76 and 77 show the paper volume state other than empty twice successively. This consequently reduces the possibility that it is erroneously determined that the paper 12 is stacked in the paper feeding tray 21 in the empty state.

Modification 2

In the above-described embodiment, the period T1 is set appropriately. The period T1 is preferably set to be longer than a period required for the actuators 74 and 75 to move from a position corresponding to a large paper volume state to a position corresponding to the empty state. This configuration reduces a possibility that, when the paper volume state is empty, the CPU 181 undesirably acquires the output signals from the sensors 76 and 77 before the actuators 74 and 75 move to the position corresponding to the empty state. If the CPU 181 undesirably acquires the output signals from the sensors 76 and 77 when the paper volume state is empty and before the actuators 74 and 75 move to the position corresponding to the empty state, there is a possibility that the CPU 181 in the paper empty detection process subroutine shown in FIG. 13 may erroneously determine that the paper 12 is stacked in the paper feeding tray 21 in spite of the fact that the paper volume state is empty, thus causing the in-detection empty flag to be reset. According to the modification 2, the period T1 is set to be longer than the period required for the actuators 74 and 75 to move from the position corresponding to the large paper volume state to the position corresponding to the empty state. This consequently reduces the possibility that it is erroneously determined that the paper 12 is stacked in the paper feeding tray 21 in spite of the fact the paper volume state is empty.

Modification 3

Figure 17:
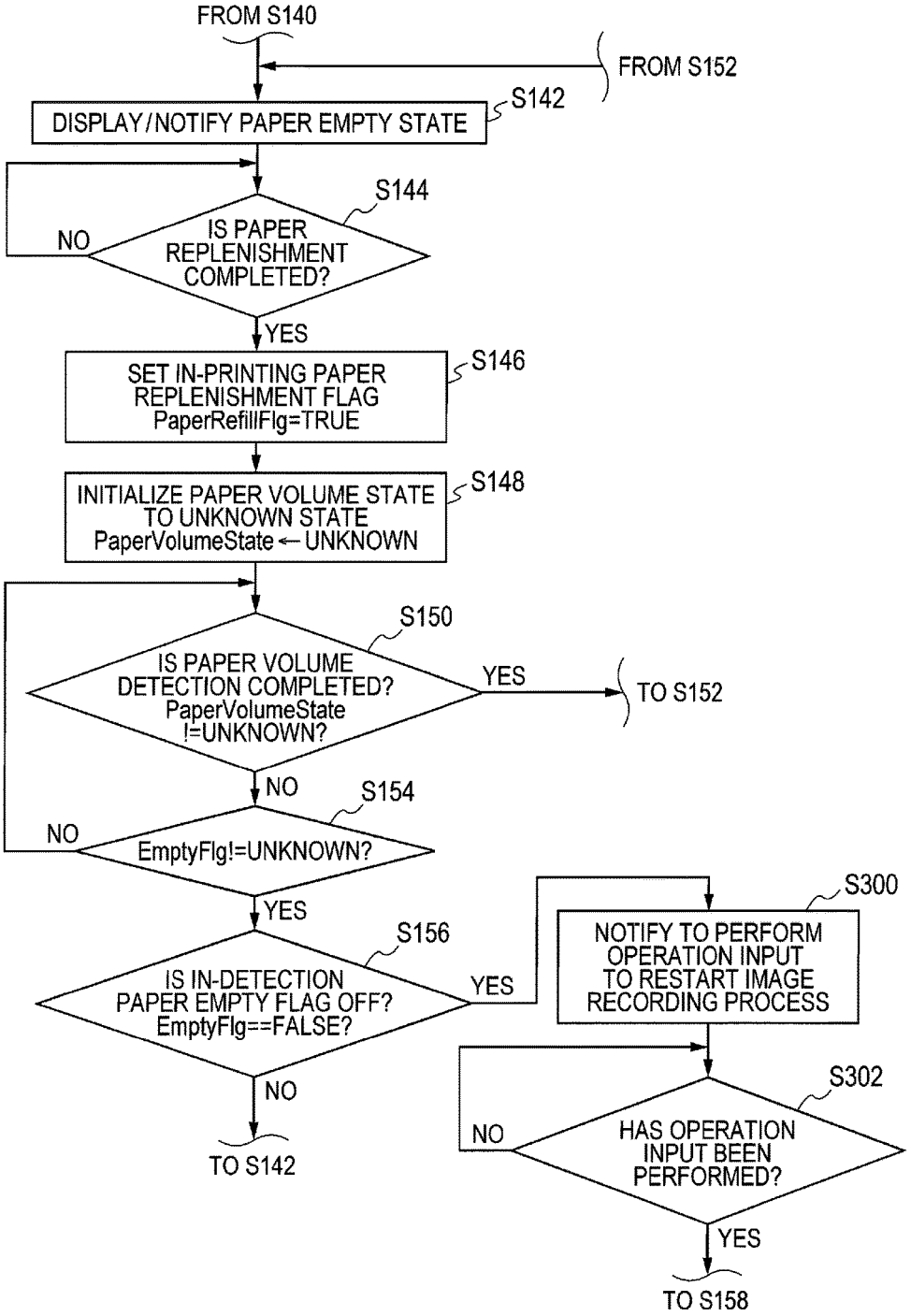
FIG. 17 is an explanatory diagram showing a paper feeding process according to a modification.

With reference to FIG. 17, a modification of the printing process will be described. In the printing process in the modification, after the completion of the paper replenishment operation by the user, the printing process is restarted based on the input operation by the user. Specifically, when the CPU 181 determines that the in-detection empty flag is reset after the paper replenishment operation is completed (S156: YES), the CPU 181 controls the display 150 to display a message to prompt the user to input an instruction for restarting the printing process through the operating interface 160 (S300). Thereafter, the CPU 181 executes S300 until an operation input for instructing restart of the printing process is inputted by the user (S302: NO). When it is determined that an operation input for instructing restart of the printing process is inputted by the user (S302: YES), then the CPU 181 executes the image recording process subroutine (S158).

According to the modification 3, the CPU 181 executes the paper feeding process when the user inputs the instruction to restart the paper feeding process. Thus, the user can restart the paper feeding process at a desired timing. Further, after it is detected that the paper 12 is stored in the paper feeding tray 21, the user is notified of the message to prompt an operation input to restart the paper feeding process. Thus, the paper feeding process can be executed immediately after the user performs the operation input. This consequently reduces a possibility that the user feels burdensome due to a time difference between the operation input by the user and the timing at which the execution of the paper feeding process is started.

Modification 4

In the above-described embodiment, in the paper remaining volume detection process shown in FIG. 12, when the combination of the output signals acquired from the sensors 76 and 77 at each period T1 is the same, the CPU 181 determines the paper volume state based on the acquired combination of the output signals. However, the method of detecting the paper volume state is not limited to this. For example, the CPU 181 may acquire the combination of the output signals from the sensors 76 and 77 a particular number of times at a particular period (particular interval), and may determine, as the actual paper volume state, the paper volume state shown by the largest number of the combinations (the most frequent combination) of output signals among the acquired output signals.

Modification 5

In the above-described embodiment, in order to detect the four types of paper volume states, the two actuators are used. However, this disclosure is not limited to this. For example, a single actuator may be provided and a plurality of sensors may be provided at different positions for the single actuator, and the single actuator may detect four types of paper volume states based on the combination of the output signals from the plurality of sensors when the single actuator takes each position depending on the paper volume state. Further, the number of the paper volume states is not limited to four types, and it may be configured that paper volume states more than four or less than four are detected.

Modification 6

In the above-described embodiment, the CPU 181 determines the paper volume state based on the combination of the acquired output signals when the combination of the output signals acquired from the sensors 76 and 77 at each period T1 is the same. However, when the paper volume state is empty, it is unlikely that the sensors 74 and 75 output a signal showing the paper volume state other than empty. Thus, the CPU 181 may determine the paper volume state as empty when one signal showing the empty state is outputted from the sensors 74 and 75. This consequently reduces a period required to detect that the paper volume state is empty, thereby providing a notification prompting the user to replenish paper at an earlier timing.

What is claimed is:

1. A sheet feeder comprising:

a medium tray on which a recording medium is stacked;

a feed roller configured to feed the recording medium stacked on the medium tray;

a driver configured to supply driving force to the feed roller;

a contact member configured to swingably move about a swing axis to contact the recording medium stacked on the medium tray, the contact member being configured to shift to different states depending on a stacked volume of the recording medium;

a sensor configured to output different signals depending on a state of the contact member;

an urging member configured to urge the contact member toward a position corresponding to the stacked volume that no recording medium is stacked on the medium tray; and a controller configured to control the driver, the controller being configured to perform:

a detection process of detecting the stacked volume based on signals of M times outputted from the sensor, the M times being a particular number of times that is larger than or equal to two times;

a stack determination process of determining whether the recording medium is stacked on the medium tray based on signals of N times, the signals of N times being a part of the signals of the M times outputted from the sensor, the N times being a particular number of times that is smaller than the M times; and a sheet feeding process of controlling the feed roller to feed the recording medium, in response to determining in the stack determination process that the recording medium is stacked on the medium tray.

2. The sheet feeder according to claim 1, wherein the contact member is configured to be in:

a first state when the stacked volume is a first volume;

a second state when the stacked volume is a second volume smaller than the first volume;

a third state when the stacked volume is a third volume smaller than the second volume; and a fourth state when no recording medium is stacked on the medium tray;

wherein the sensor is configured to output:

a first signal when the contact member is in the first state or while the contact member is shifting from the first state to the second state;

a second signal when the contact member is in the second state or while the contact member is shifting from the second state to the third state;

a third signal when the contact member is in the third state or while the contact member is shifting from the third state to the fourth state; and a fourth signal when the contact member is in the fourth state; and wherein the controller is configured to, in the stack determination process, determine that the recording medium is stacked on the medium tray, in response to determining that one of the first signal, the second signal, and the third signal is outputted once from the sensor.

3. The sheet feeder according to claim 2, wherein the controller is configured to:

perform the sheet feeding process in response to detecting in the detection process that the stacked volume is other than a fourth volume, the fourth volume being a volume in a state where no recording medium is stacked on the medium tray; and perform the stack determination process in response to detecting in the detection process that the stacked volume is the fourth volume.

4. The sheet feeder according to claim 2, wherein the controller is configured to, in the stack determination process:

when an elapsed period after determining that replenishment of the recording medium is completed is longer than or equal to a first period, determine that the recording medium is stacked on the medium tray in response to determining that one of the first signal, the second signal, and the third signal is outputted once from the sensor; and when the elapsed period after determining that replenishment of the recording medium is completed is shorter than the first period, determine that the recording medium is stacked on the medium tray in response to determining that one of the first signal, the second signal, and the third signal is outputted at least twice successively from the sensor.

5. The sheet feeder according to claim 2, wherein the sensor is configured to output a signal depending on a posture of the contact member at each second period; and wherein the second period is longer than a period required for the contact member to shift from the first state to the fourth state when the stacked volume is the fourth volume.

6. The sheet feeder according to claim 2, wherein, when the contact member is in the fourth state, the contact member is configured to enter a hole formed in a bottom surface of the medium tray.

7. The sheet feeder according to claim 2, wherein the sensor comprises a first optical sensor and a second optical sensor;

wherein the contact member comprises:

a first actuator having a first interference portion; and a second actuator having a second interference portion;

wherein the first optical sensor is configured to be in:

an interference state when the first interference portion enters a first optical path of the first optical sensor; and a retracted state when the first interference portion is retracted from the first optical path;

wherein the second optical sensor is configured to be in:

an interference state when the second interference portion enters a second optical path of the second optical sensor; and a retracted state when the second interference portion is retracted from the second optical path;

wherein the first signal is obtained when the first optical sensor is in the retracted state and the second optical sensor is in the retracted state;

wherein the second signal is obtained when the first optical sensor is in the interference state and the second optical sensor is in the retracted state;

wherein the third signal is obtained when the first optical sensor is in the interference state and the second optical sensor is in the interference state; and wherein the fourth signal is obtained when the first optical sensor is in the retracted state and the second optical sensor is in the interference state.

8. The sheet feeder according to claim 3, further comprising a display configured to display the stacked volume that is detected in the detection process, wherein the controller is further configured to:

perform a replenishment notification process of, in response to detecting in the detection process that the stacked volume is the fourth volume, controlling the display to display a notification for replenishing a recording medium to the medium tray;

perform a replenishment determination process of determining whether replenishment of the recording medium to the medium tray is completed after performing the replenishment notification process;

perform the stack determination process in response to determining in the replenishment determination process that replenishment of the recording medium is completed.

9. The sheet feeder according to claim 8, further comprising a detector configured to detect that the medium tray is mounted on a main body of the sheet feeder, wherein the controller is further configured to determine that replenishment of the recording medium is completed, in response to detecting in the replenishment determination process that the medium tray is mounted on the main body of the sheet feeder after performing the replenishment notification process.

10. The sheet feeder according to claim 8, further comprising an operating interface, wherein the controller is configured to:

in response to determining in the stack determination process that the recording medium is stacked on the medium tray, perform an input notification process of controlling the display to display a notification for prompting an operation input, through the operating interface, for performing the sheet feeding process; and perform the sheet feeding process in response to receiving the operation input after performing the input notification process.

11. The sheet feeder according to claim 1, wherein the controller is configured to, in the detection process, determine whether signals indicative of a same stacked volume are outputted twice successively from the sensor; and in response to determining that the signals indicative of the same stacked volume are outputted twice successively from the sensor, detect the stacked volume based on the signals.

12. An image recording apparatus comprising:

a medium tray on which a recording medium is stacked;

a feed roller configured to feed the recording medium stacked on the medium tray;

a printer configured to record an image on the recording medium fed by the feed roller;

a driver configured to supply driving force to the feed roller;

a contact member configured to swingably move about a swing axis to contact the recording medium stacked on the medium tray, the contact member being configured to shift to different states depending on a stacked volume of the recording medium;

a sensor configured to output different signals depending on a state of the contact member;

an urging member configured to urge the contact member toward a position corresponding to the stacked volume that no recording medium is stacked on the medium tray; and a controller configured to control the driver, the controller being configured to perform:

a detection process of detecting the stacked volume based on signals of M times outputted from the sensor, the M times being a particular number of times that is larger than or equal to two times;

a stack determination process of determining whether the recording medium is stacked on the medium tray based on signals of N times, the signals of N times being a part of the signals of the M times outputted from the sensor, the N times being a particular number of times that is smaller than the M times;

a sheet feeding process of controlling the feed roller to feed the recording medium, in response to determining in the stack determination process that the recording medium is stacked on the medium tray; and a recording process of controlling the printer to record an image on the recording medium fed in the sheet feeding process.

* * * * *